US009918499B2

(12) United States Patent
Solotoff

(10) Patent No.: US 9,918,499 B2
(45) **Date of Patent: *Mar. 20, 2018**

(54) BRASSIERE PROVIDING CONTINUOUS ADJUSTABILITY BETWEEN DIFFERENT LIFT POSITIONS AND/OR CONVERTIBILITY BETWEEN MINIMIZER AND MAXIMIZER SUPPORT

(71) Applicant: Brandon Solotoff, Great Neck, NY (US)

(72) Inventor: Brandon Solotoff, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/252,475

(22) Filed: Aug. 31, 2016

(65) Prior Publication Data

US 2017/0027241 A1 Feb. 2, 2017

Related U.S. Application Data

(63) Continuation-in-part of application No. 14/860,855, filed on Sep. 22, 2015, now Pat. No. 9,585,424, which is a continuation-in-part of application No. 14/475,730, filed on Sep. 3, 2014, now Pat. No. 9,504,281, which is a continuation of application No. 13/456,398, filed on Apr. 26, 2012, now Pat. No. 8,821,210, which is a continuation-in-part of application No. 13/068,100, filed on May 2, 2011, now Pat. No. 8,668,549.

(60) Provisional application No. 61/463,352, filed on Feb. 15, 2011, provisional application No. 61/518,168, filed on Apr. 29, 2011.

(51) Int. Cl.
*A41C 3/00* (2006.01)

(52) U.S. Cl.
CPC ..... *A41C 3/0028* (2013.01)

(58) Field of Classification Search
CPC ..... A41C 3/00; A41C 3/02; A41C 3/0021; A41C 3/0028; A41C 3/10
USPC ..... 450/60–63, 59, 41, 45, 51
See application file for complete search history.

(56) References Cited

U.S. PATENT DOCUMENTS 2,734,192 A * 2/1956 Panes ..... B25C 5/11 227/134
5,904,430 A * 5/1999 Alessi ..... B43K 27/00 220/4.27
7,452,260 B2 * 11/2008 Redenius ..... A41C 3/0021 450/60

(Continued)

*Primary Examiner* — Gloria Hale
(74) *Attorney, Agent, or Firm* — Thomas A. O'Rourke; Bodner & O'Rourke, LLP

(57) ABSTRACT

An adjustable support brassiere comprises traditional bra elements—a bra band with closure; left and right breast cups; and respective shoulder straps. Adjustability may comprise left and right inner support cups having inner ends pivotally attached, respectively, to the left and right breast cups, and a respective support strap having a bottom end attached at a distal (outer) end of each inner support cup, with a top end of each support strap fixedly secured to a clamp member. Each of the left and right clamp members may be releasably secured to a infinite number of positions of the shoulder strap, to cause individual lifting and reconfiguring of the left and right inner support cups to produce a desired amount of lifting to each of the woman's breasts. Adjustments may be made by a woman throughout the day to alter her appearance as desired.

9 Claims, 23 Drawing Sheets

(56) References Cited

U.S. PATENT DOCUMENTS

| | | | | |
|---|---|---|---|---|
| 7,677,951 | B2 * | 3/2010 | Redenius | A41C 3/0021 450/60 |
| 8,187,054 | B2 * | 5/2012 | Redenius | A41C 3/0021 450/59 |
| 8,668,549 | B2 * | 3/2014 | Solotoff | A41C 3/0028 450/60 |
| 8,821,210 | B2 * | 9/2014 | Solotoff | A41C 3/10 450/63 |
| 9,504,281 | B2 * | 11/2016 | Solotoff | A41C 3/0028 |
| 9,585,424 | B2 * | 3/2017 | Solotoff | A41C 3/0028 |
| 2005/0277364 | A1 * | 12/2005 | Redenius | A41C 3/0021 450/41 |
| 2007/0232190 | A1 * | 10/2007 | Redenius | A41C 3/0021 450/41 |
| 2010/0130098 | A1 * | 5/2010 | Kammerer | A41C 3/02 450/39 |
| 2010/0210179 | A1 * | 8/2010 | Redenius | A41C 3/0021 450/63 |

* cited by examiner 3A, 3C, 3D, 3F

BRASSIERE PROVIDING CONTINUOUS ADJUSTABILITY BETWEEN DIFFERENT LIFT POSITIONS AND/OR CONVERTIBILITY BETWEEN MINIMIZER AND MAXIMIZER SUPPORT

CROSS REFERENCE TO RELATED APPLICATIONS

This application is a continuation-in-part of U.S. patent application Ser. No. 14/860,855, filed on Sep. 22, 2015, now issued as U.S. Pat. No. 9,585,424, which is a continuation-in-part of U.S. patent application Ser. No. 14/475,730, filed on Sep. 3, 2014, now issued as U.S. Pat. No. 9,504,281, which is a continuation of U.S. application Ser. No. 13/456,398, filed on Apr. 26, 2012, now issued as U.S. Pat. No. 8,821,210, which is a continuation-in-part of U.S. application Ser. No. 13/068,100, filed May 2, 2011, now issued as U.S. Pat. No. 8,668,549, which claims priority on U.S. Provisional Application Ser. No. 61/463,352, filed on Feb. 15, 2011, and on U.S. Provisional Application Ser. No. 61/518,168, filed Apr. 29, 2011, with the disclosures of each being incorporated herein by reference.

FIELD OF THE INVENTION

The present invention relates to improvements in brassieres, and more particularly to brassieres that provide adjustable support.

BACKGROUND OF THE INVENTION

Over the course of history, undergarments dedicated to providing support for, and/or for accentuating a woman's physique, particularly her breasts, have changed, in part, according to societal norms. It is well known that the Minoan women living on the Greek isle of Crete, around 2500 B.C., wore bra-like garments that served to lift their bare breasts out from their clothes. During the 1500s and later, corsets were worn, which tended to provide upward support for the wearer's breasts. In the latter part of the 1800s, the corset was split by some into a girdle for torso support and an upper device suspended from the shoulders for breast support. Such devices are found in various historic sources and reported in modem published accounts such as "Bra: A Thousand: Years of Style, Support & Seduction," by Stephanie Pedersen.

During, the late Victorian period in the United Kingdom, a "bust bodice," commonly referred to then as a "BB", was dedicated to providing basic shape and support for a woman's breasts by creating a mono-bosom effect with examples being found today in English museums (see http://museums.leics.gov.uk/collections-on-line/GetObjectAction-.do?objectKey=103636). The bust bodice was essentially just a frilled, white cotton cloth that surrounded both breasts and was supported by a pair of straps, and fastened, at the back by laces and/or a button.

Earliest use of the term, "brassiere" in the United States is considered to be by the Syracuse Evening Herald in March 1893, in referring to a six-inch straight, boned band being necessary for fashionable gowns, at the time, while Vogue magazine used the term in 1907, and it was first adopted into the Oxford English Dictionary in 1911. However, first use of the term "Brassiere" in a patent was by Mary Jacob in the 1914 U.S. Pat. No. 1,115,674. But ironically, although she is often credited as inventing the first "modern bra," the device did not comprise cups for individual support of the wearer's breasts, and more closely resembled its progeny in the form, of the bust bodice. Some tend to credit H. S. Lesher for his "Combined Breast Pads and Ami-Pit Shield" shown in the 1859 U.S. Pat. No 24,033, as perhaps being the inventor of the bra, since part of its function is described as providing "a symmetrical rotundity to their breasts," Certain historians attribute Luman L. Chapman's 1863 U.S. Pat. No. 40,907 for an improved "Corset," as being the "proto-brassiere." Olivia. P. Flynt also received multiple U.S. patents for articles of clothing, and in 1876 received U.S. Pat. No. 173,611 for a "Bust Supporter", which states, among other things, that if "adapted to ladies having large breasts," that it "was specially designed as a bust support and improver" being designed for "producing a more comely outline and comfortable feeling than the corset," and that it "will be used instead of and take the place of the corset." Many others may justifiably attribute invention of the first modern bra to be the device that was patented and unveiled at the Exhibition of 1889 in France, by corset-maker Herminie Cadolle. She displayed her bra-like device—part of a two-piece corset, that was called Bien-être," meaning "Well-Being" (although it was initially called the "corselet gorge"), which was sold as a health aid. The first patenting within the U.S. of something closely resembling the modem bra was by Marie Tucek for her "Breast Supporter." The Tucek breast supporter received protection under the 1893 U.S. Pat. No. 494,397, and comprised a pair of cups that provided support through a pair of shoulder straps, and outwardly resembled the contemporary brassiere.

Today, a woman's bra functions not only to provide basic support, but also must fulfill ever increasing demands in terms of it being fashionable and shape-enhancing. One current demand is that the woman be able to use the bra to appear professional by daytime, which in some social circles or offices may entail appearing more conservatively, but once leaving the professional environment to enjoy late afternoon, and early evening social events, the woman may desire to use the same bra to enhance her figure and appear more voluptuous, even seductively enhanced and suggestive, without having to change garments.

Although there are some prior art bras that function to enhance a women's bust fine, such as the series of patents to Redenius (U.S. Pat. No's. 7,452,260, 7,497,760, 7,645,179, and 7,677,951), each of these methods of enhancement undesirably causes inward, rotation of the women's bust, which is detrimental to the health of the breast tissue. The brassiere invention disclosed herein permits a woman to achieve positive results, in which she may either tone down or accentuate her figure, but without the unhealthy consequences associated with the prior art.

OBJECTS OF THE INVENTION

It is an object of the invention to provide a bra that allows a woman, to easily and conveniently adjust the support provided by the bra's cups.

It is another object of the invention to provide an adjustable bra that enhances the appearance of a woman's physique by permitting vertical adjustments to the lift being provided to her breasts.

It is a further object of the invention to provide a bra that provides a lift enhancing feature that may be adjusted while the woman is wearing the bra.

It is another object of the invention to provide a bra with an adjustable lift feature that provides vertical support, but without corresponding inward convergence for healthier support of the woman's breast tissue.

Further objects and advantages of the invention will become apparent from the following description and claims, and from the accompanying drawings.

SUMMARY OF THE INVENTION

The bra of the present invention has the ability to be adjusted to provide various degrees of lift in the vertical direction, to enhance the woman's figure in a healthier manner than is provided by prior art inward breast-displacing bra types, and uses a novel construction for the components therein.

The adjustable support brassiere may comprise a bra band; at least one breast cup being secured to a portion of the bra band; and a shoulder strap for each of the at least one breast cup, with the shoulder strap having a first end being secured to the bra band. An inner support cup for each of the at least one breast cup may have a first end and a second end being attached at a selective location on the respective breast cup. A portion proximate to the first end of the support strap may be secured to the inner support cup, with a second end of the support strap being secured to a support cup adjustment clip. A portion of the shoulder strap proximate to its second end may be releasably secured to the support cup adjustment clip, to permit substantially vertical adjustments of a selective portion of the inner support cup. These adjustments may serve to configure or reconfigure the inner support cap to be at a desired position.

Two different types of embodiments may be utilized for the support cup adjustment clip. In one embodiment, the clip may be the same as the typical shoulder strap-length adjustment clip utilized on many bras, which would permit generally continuous advancements of the strap to achieve lift. A second type of embodiment for the support cup adjustment clip may preferably permit incremental advancements, and may take several different forms, each of which may comprises a prong of some sort, while a portion of the shoulder strap may comprises two or more openings of some sort, so that the shoulder strap may be releasably secured to the support cup adjustment clip by having the prong being releasably received within one of the two or more openings. The openings may comprise fabric loops or eyelets, while the incremental support cup adjustment clip may comprises a hook member, a buckle, or a swan hook.

A first desired position may comprises a normal position at which a bottom of the inner support cup is coterminous with a bottom portion of the at least one breast cup. Adjustments may be made by releasing of the opening of the shoulder strap from the prong of the support cup adjustment clip, and causing movement of the shoulder strap relative to the support cup adjustment clip to secure another one of the openings using the prong, which may serve to cause reconfiguring of a portion of the inner support cup to be at a second desired position, which may comprise a vertically elevated position. With the inner support cup being, stitched to the breast cup at its two ends, the reconfiguring instigated by the support strap may cause the inner support cup to be elevated vertically by having a portion between its first and second ends being elevated, possibly through elastic deformation of a stiffening member in the inner support cup.

An elastic breast-cup support strap for each of the at least one breast cup may have a first end being secured to the support cup adjustment clip, and a second end being secured to a portion of the at least one breast cup to coordinate movement of a portion of the breast, cup with the elevated movement of the inner support cup.

BRIEF DESCRIPTION OF THE DRAWINGS

FIG. 10A shows a cross-sectional view through the breast cup underwire of the bra of FIG. 10, taken at the transvers opening therein.

FIG. 10B shows a cross-sectional view through an alternate embodiment of breast cup underwire that may alternatively be used for the bra of FIG. 10.

FIG, 17 illustrates yet another embodiment of an adjustable bra in accordance with the present invention.

Figure 18:
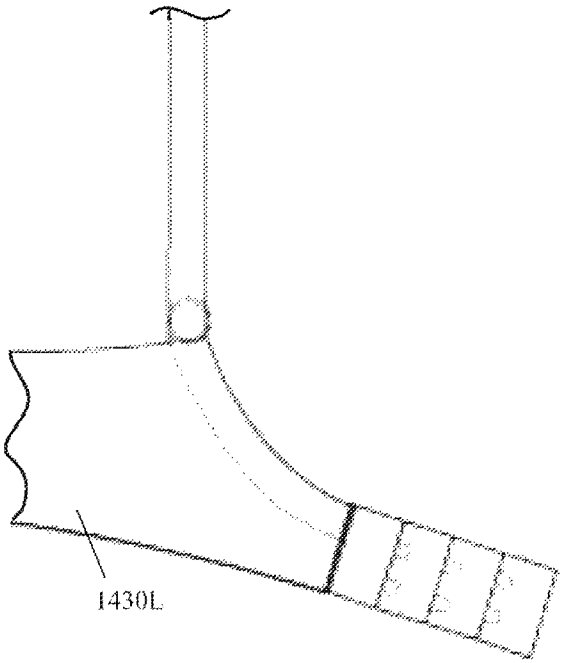

FIG. 18 is an enlarged detail view of one end of the bra strap having three pairs of eyelets positioned thereon.

Figure 19A:
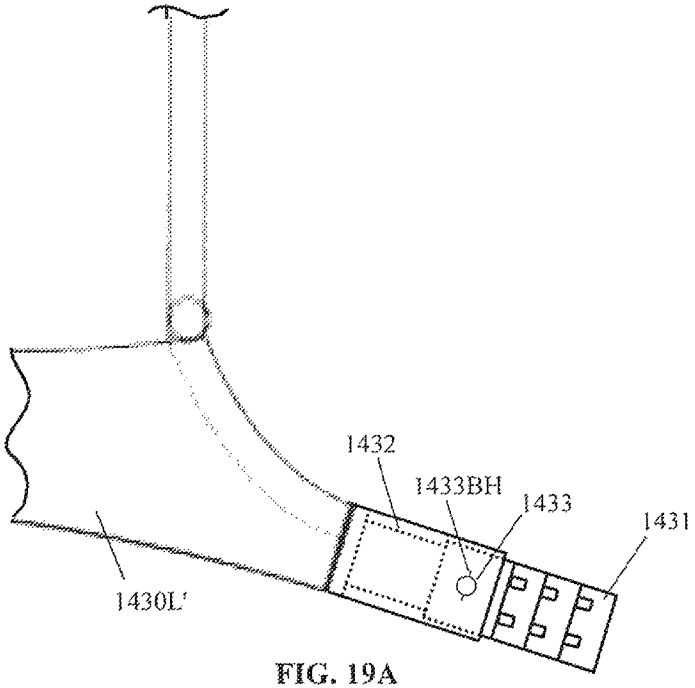

FIG. 19A is an alternate embodiment of the end of the bra strap, in accordance with the present invention, having a length adjustment feature formed therein.

Figure 19B:
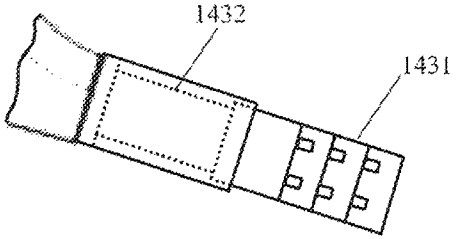

FIG. 19B illustrates the alternative bra strap end of FIG. 19A, shown in an extended position.

DETAILED DESCRIPTION OF THE INVENTION

As used throughout this specification, the word "may" is used In a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone: or A -and B together; or A and C together; or B and C together; or A, B and C together.

Also, all references (e.g., patents, published patent applications, and non-patent literature) that are cited within this, documents are incorporated herein in their entirety by reference.

Furthermore, the described features, advantages, and characteristics of any particular embodiment disclosed in the following specific a lion, may be combined In any suitable manner with any of the other embodiments disclosed herein.

Figure 1:
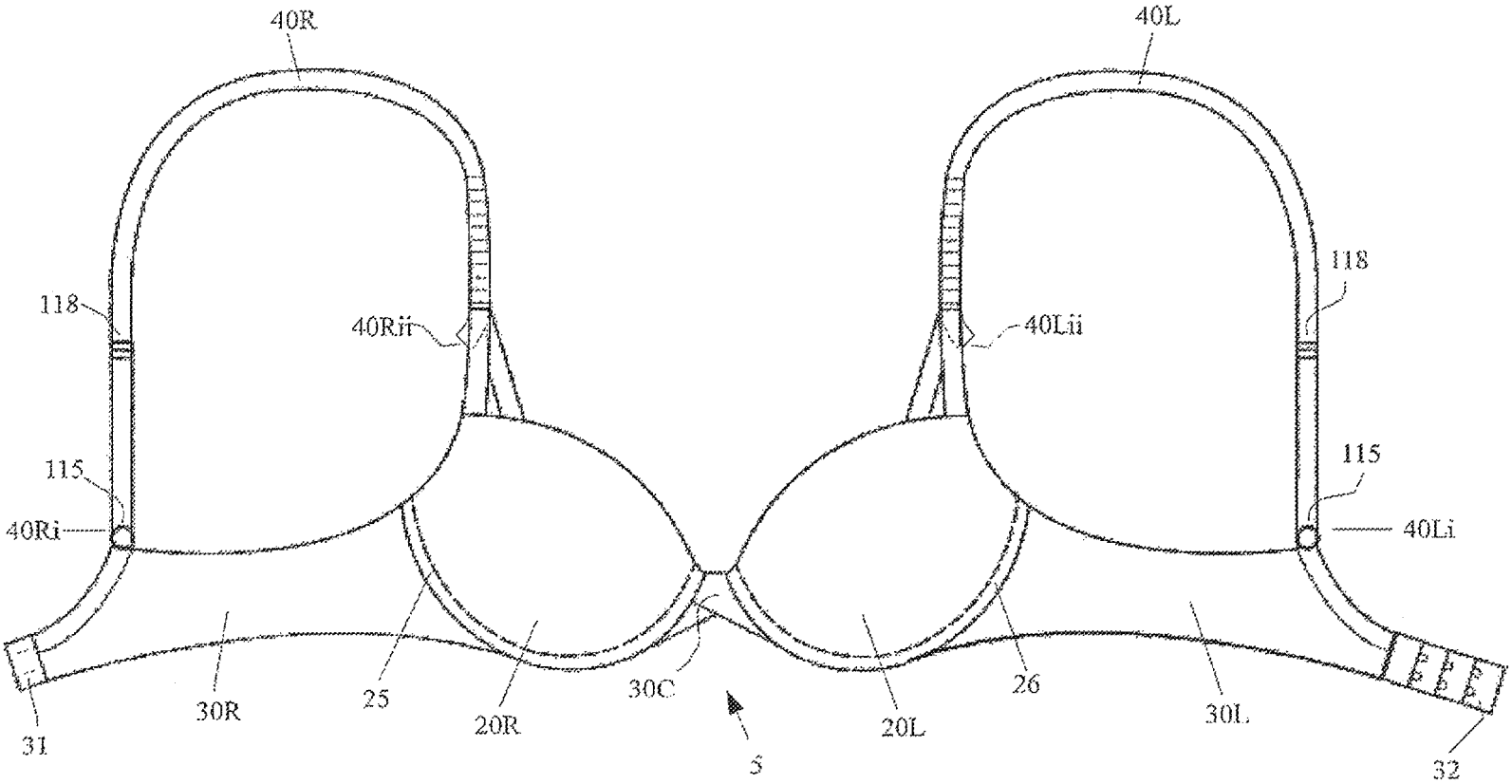
FIG. 1 generally shows a front view of a vertically adjustable support bra of the current invention.

The present invention relates to a bra, as well as teddies, corsets, breast feeding bras, minimizers, lingerie, bikinis, and the like, that may be adjustable to enable a wearer to easily and conveniently adjust the amount of lift provided, to be able it to transition quickly from a bra that provides a conservative appearance with a requisite support amount/type, to a bra that enhances a woman's bustline. FIG. 1 shows a front view of the adjustable bra 5. The adjustable bra 5 may have certain portions constructed and assembled, in the same way that a conventional bra is assembled. Adjustable bra 5 may have one or two breast cups, and may be comprised of a left breast cup 20L and a right breast cup 20R. The breast cups may be formed of a sturdy inelastic material, or may alternatively be constructed of an elastic material which still provides some support, but is nonetheless stretchable or elastically deformable to a certain degree. The bottom of each breast cup 20L and 20R may contain underwire 25 and 26, respectfully. Although the underwire 25 and 26 appears to be substantial in size within FIG. 1, its appearance therein may be overstated only to make the reader aware of its presence. The underwire may be small in size, and rather than being a "wire," it may instead be a thin, semi-circular strip of rigid material having a circular or rectangular cross-section, so as to be flexible in conforming to, and resting against, the chest of the wearer, while still providing adequate stiffness in the vertical direction. This cross-sectional shape may serve to reduce the appearance of the "underwire" when the lifting components of the bra of the present invention are utilized. However, the invention may be successfully practiced without the use of an underwire being secured within the bottom of the breast cups.

Figure 1A:
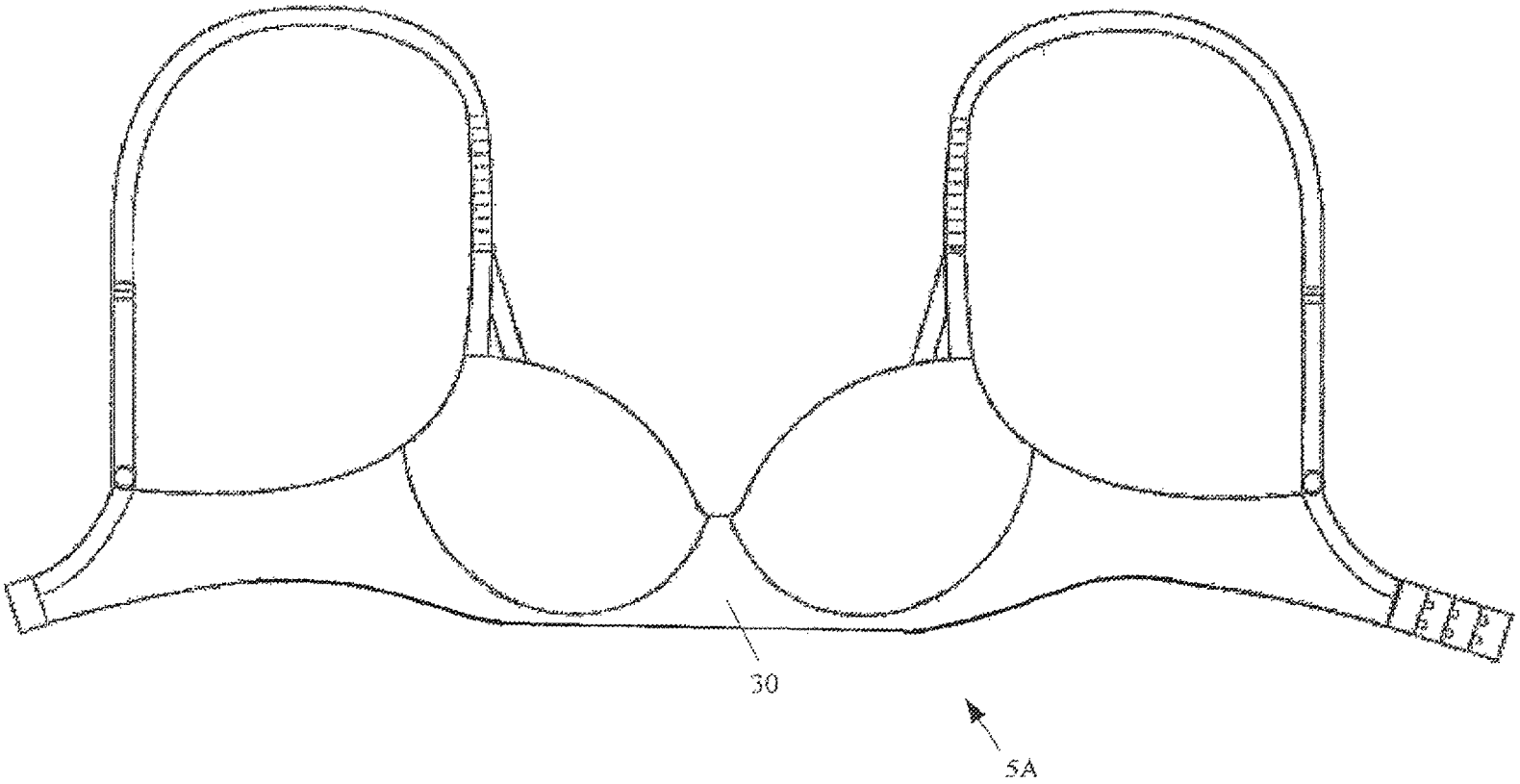
FIG. 1A shows an alternative embodiment of the bra of FIG. 1, having a continuous bra band.

The breast, cups 20L and 20R may be properly spaced apart and situated to enclose a woman's breasts, by attachment, which may comprise stitching to a portion of art encircling band—the bra band that is used to attach the bra about a women's torso. Adjustable bra 5 may comprise three distinct bra band segments, 30L, 30R and 30C, where the bra band 30L is attached to and extends away from the left breast cup 20L, the bra band 30R is attached to and extends away from the right breast cup 20R. and the bra band 30C is centrally attached to and extends in between both breasts cups, 20L and 20R. As seen for bra 5A in FIG. 1A, a single bra band 30 may alternatively be used in place of the multiple bra band segments.

The single bra band 30 may be continuous at the back of the wearer, so that the garment may resemble a pull-on type of bra, similar to many sports bras today. Where there is either the single bra band 30 or a segmented bra band, and where they are not integrally connected necessitating the pull-on method, a split in the band may be fastened together to secure the bra about the women's torso using a typical means of closure, such as a hook 31 and eye 32 joining system, or a button and button hole, etc. It is also common today for a bra to be constructed with a bra band 30C that may be continuous except for a split between the two cups where the split bra bands may be connected with a front closure means, such as the arrangement shown by U.S. Pat. No. 4,411,269 to Weintraub for "Front Opening Bra With Adjustable Back," the disclosures of which are incorporated herein by reference.

Figure 1B:
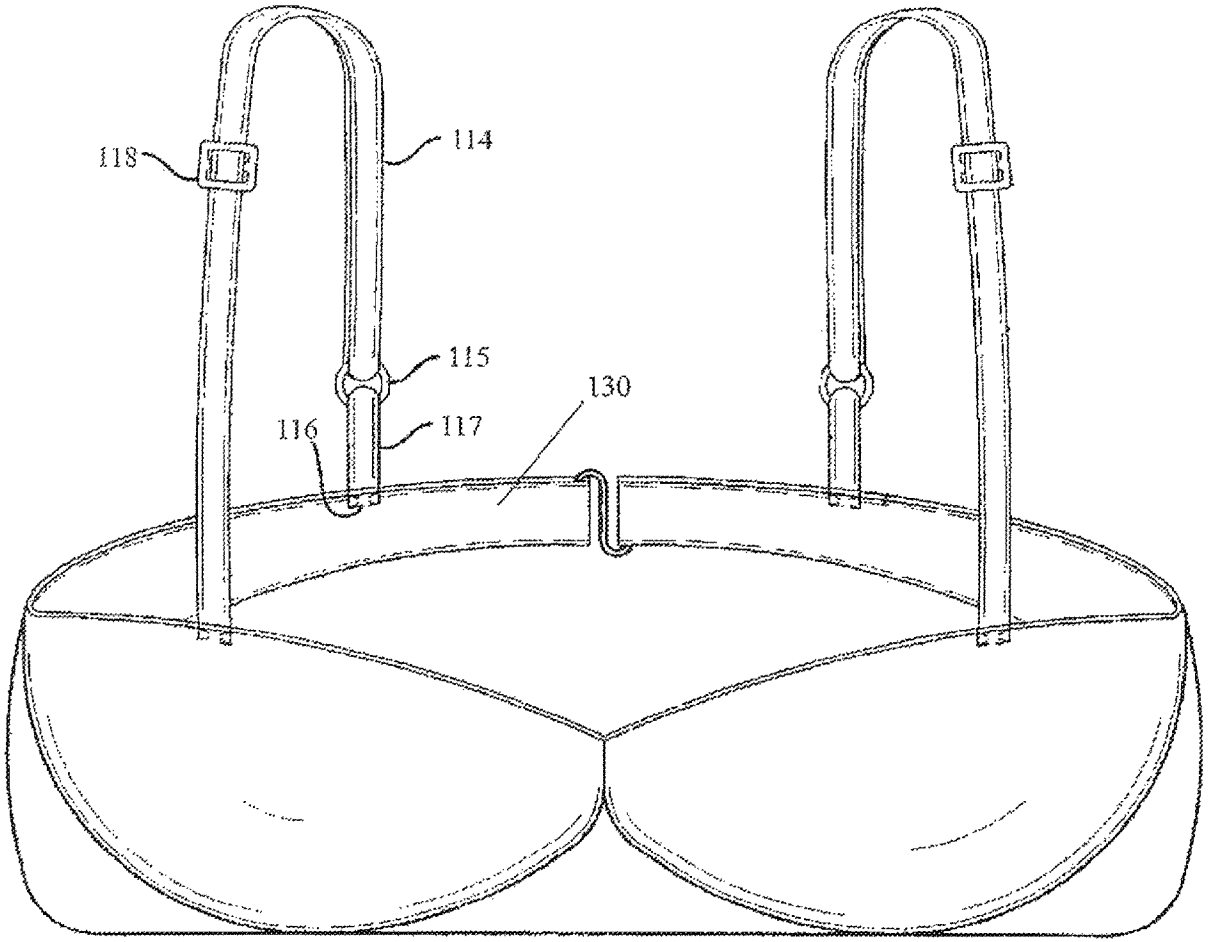
FIG. 1B (Prior Art)
FIG. 1B is a front view of a prior art bra, illustrating-prior art attachment of the shoulder strap to the bra band.

The bra 5 of the present invention may have respective shoulder straps 40L and 40 R, for each of the breast, cups 20L and 20R. The shoulder straps 40L and 40R may have a first end, 40Li and 40Ri respectively, which may be secured to a portion of the bra band in accordance with a conventional bra structural arrangement per the prior art bra illustrated in FIG. 1B herein, and as described in U.S. Pat. No. 6,186,861 to Flaherty, the disclosures of which are incorporated herein by reference. In FIG. 1B, a small strap portion 117 may loop about a ring 115 and have stitches 116 being used for stitching ends of strap portion 117 to the bra band 130. A main strap 114 may loop about ring 115 and utilize a conventional strap length adjustment clip 118 for adjusting the nominal length of the bra shoulder straps while the bra is being worn to provide the ordinary support that is required for regular, conservative use having an unenhanced appearance. Alternatively, as seen in FIG. 1 herein, a ring 115 may be stitched directly to a portion of bra bands 30R and 30L of bra 5, eliminating the need for strap 117 of the prior art.

A second end, 40Lii and 49Rii of straps 40L and 40R may provide unique connectivity with breast cups 20L and 20R, and unique connectivity with specially constructed support structure located therein, to thereby be particularly operable to provide only substantially vertical lifting of the wearer's breast(s). The arrangement of those elements will, be particularly directed to also permit spontaneous adjustments to the amount that the woman's breasts are lifted for enhancement of her figure.

Figures 2A, 3A, 3B, 3C, 3D, 3E, 3F, 3G, 3H, 4:
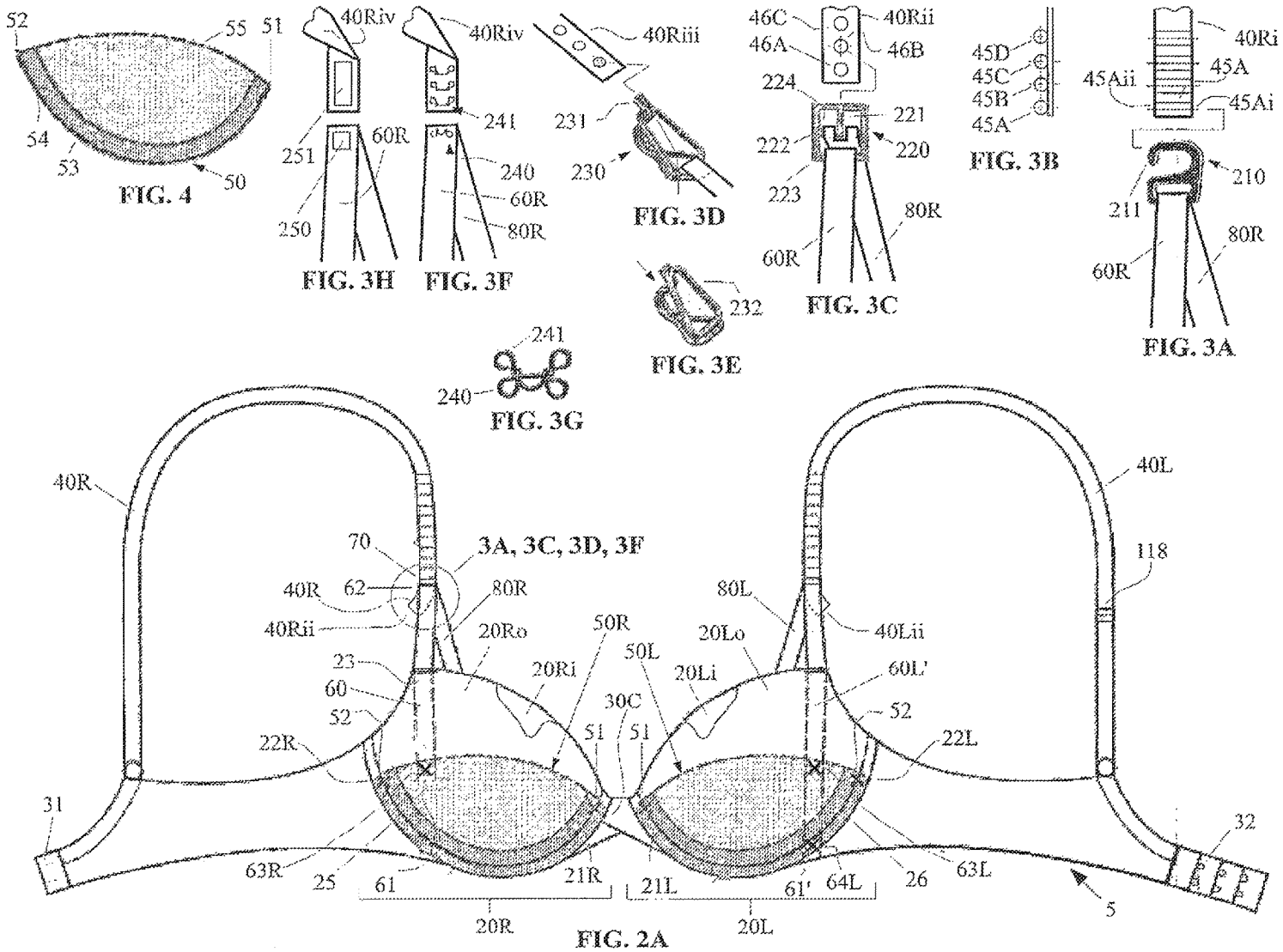
FIG. 2A is the front view detailing a first embodiment of the vertically adjustable support bra of FIG. 1, showing inner details of the bra's support capability, with the inner cup being in the unadjusted position.
FIG. 3A illustrates a hook member attached to the support strap and a series of looped opening in the bra shoulder strap, to permit vertical adjustment to the inner support cup.
FIG. 3B is a side view of the series of looped opening in the bra shoulder strap shown of FIG. 3A.
FIG. 3C illustrates a buckle member that may have the support strap attached thereto, to be connectable with a series of eyelets or openings in the bra shoulder strap, to permit vertical adjustment to the inner support cup.
FIG. 3D illustrates a swan hook member that may have the support strap attached thereto, with the hook portion of the swan hook member being receivable within one of a series of eyelets or openings in the bra shoulder strap, to permit vertical adjustment to the inner support cup.
FIG. 3E illustrates the swan hook member of FIG. 3D being shown by itself, and with the hook portion disengaged from the frame.
FIG. 3F illustrates a hook member that may be attached to the support strap, with the hook being releasably connectable to one of a series of catches attached to the bra shoulder strap (or vice versa), to permit vertical adjustment to the inner support cup.
FIG. 3G illustrates the hook and catch of FIG. 3E being shown by themselves and engaged with each other.
FIG. 3H illustrates Velcro being attached to the support strap and shoulder strap to thereby permit adjustments to the inner support cup.
FIG. 4 is a front view of the inner support cup.

FIG. 2A illustrates the bra components that may permit substantially vertical lifting. As seen in FIG. 2A, a support strap 60 may have a first end 61 that may be attached to an inner support cup 50, which may vary in size according to the size of the breasts cups, 20L and 20R. Inner support cup 50, also shown separately in FIG. 4, may have a first end 51 and a second end 52, and may be made of a flexible, though generally inelastic material. The inner support cup 50 may be shaped so as to normally have a curved bottom surface 53 nest close to the bottom portion of the breast cup, so as be normally conterminous therewith. The lower curved bottom 53 may normally retain such a complementary shape by incorporating a flexible stiffening member 54 with, corresponding curvature, which may be secured to the material of the inner support cup. Where an underwire 21/22 is utilized for the breast cups, the curvature of-the flexible stiffening member 54 may correspond to the curvature of the underwire. The flexible stiffening member 54 may be bonded to the material of the inner support cup 50, or the material of the inner support cup may be sewn to form a pocket with the stiffening member 54 being received therein, or the flexible stiffening member may be attached using any other means known within the art for securing bra underwire. An upper curved edge boundary 55 of the inner support cup 50 may be generally curved so that in a front view of the cup, the inner support cup may appear to be elliptically shaped.

Figure 6:
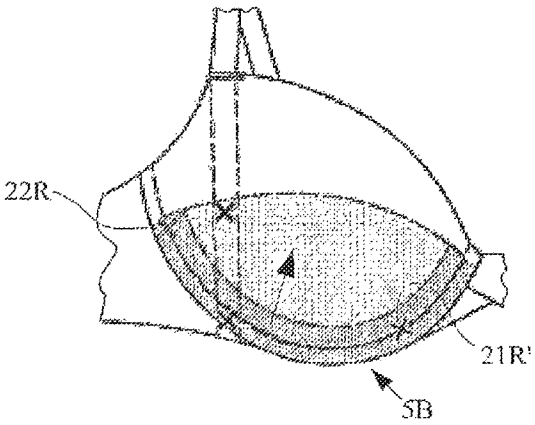
FIG. 6 is a second alternate embodiment showing the right breast cup and inner support cup of the bra of FIG. 2A, but having an inner support point 21R' positioned to provide both vertical lift and some inwardly directed lift.

The inner support cup 50 may be secured to the respective breast cup 20R/20L by attaching a portion proximate to the first and second ends, 51 and 52, of the inner support cup to the respective breast cups. Note that curvature may be slightly different—probably opposite—for the two breast cups, necessitating use of left-hand and right-hand inner support cups, 50R/50L. The first and second ends, 51, 52, for each of the Inner support cups, 50R/50L, may be secured at points 21R/22R and 21L/22L using one of several different methods. One method is to stitch the inner support cup to the respective breast cup at those locations. The stitching may be concentrated at one particular point location, 21R/22R, and 21L/22L, marked by the "X" in FIG. 2A, to secure the inner support cup thereat, and may thus generally serve as a pivot location. Alternatively, a snap fastener may be used to pivotally secure the inner support cup to the breast cup, which may include, but is not limited to, the male and female snap members of expired U.S. Pat. No, 3,975,803 to Katayama, the disclosures of which are incorporated, herein by reference. Any other suitable snap known in the art may also be used. Positioning of the points 21R/22R and 21L/22L for securing of the Inner support cups 50R/50L relative to the respective breast cups 20R/20L affects the type of lifting that will result. To achieve substantially vertical lift, which is advantageous both for figure enhancement and for the women's breast tissue health, the points 21R and 22R will be positioned generally very close to same height above the lowest point of the cup. Where some amount of Inward lift may also be desired, the outer support point 22R may be at a greater height, than the inner support point 21R from the lowest point (see point 21R' for bra 5B in FIG. 6), and conversely, where some amount of outward lift is desired, the Inner support point 21R may be at a greater height than the outer support point 22R. These characteristics will become evident, from the ensuing, paragraphs and the detailed descriptions relating to FIG. 5.

The support strap 60 may have a first end 61 that may be attached to inner support cup 50 through the use of stitching (63R and 63L for the left-hand and right-hand cups), and may be attached to an upper portion of the inner support cap that is proximate to the upper curved edge boundary 55. In one embodiment, the breast cups 20R and 20L may be formed with a secondary inner layer of material that may be in contact with the woman's breast, and thus the breast cups may constitute, where this embodiment is utilized, the outer/original layers 20Lo/20Ro and inner layers 26Li/20Ri that may respectively be stitched together at their periphery. For greater comfort to the wearer and to permit easier movement of the inner support cup, the inner layers 20Li/20Ri may comprise a smooth tricot liner. Where an embodiment with inner layers 20Li/20Ri is utilized, the stitching used to secure the inner layers may be interrupted in the region around the support strap 60 to create an opening 23, so that the strap may move freely relative to the breast cups 20L/20R.

The second end 62 of the support strap 60 may be secured to a support cup adjustment clip 70, which may releasably receive the second end 40Rii of the shoulder strap 40R to permit quick adjustment, at the woman's forward facing side, to the length of the shoulder strap to shorten the effective strap length. The support cup adjustment clip 70 may obviate the need for the strap length adjustment clip 118, which is not shown for the right shoulder strap 40R in FIG. 2A.

The support cup adjustment clip 70 may simply be the strap length adjustment clip 118 being utilized on the front side as shown, which would permit continuous advancement of the shoulder strap. Such advancement would cause the shoulder strap to be secured so as to shorten its effective length, which h would be accompanied, because of its attachment to the inner support cup, by the inner cup essentially "reconfiguring" itself to be at a desired position, as seen, for example, in FIG. 5. The breast cups 20R and 20L may be formed of elastic material, and may be supported by a strap 80R/80L that has a first end 81 being attached to the top of the breast cup and a second end 82 being attached to the second end 62 of support strap 60 or being attached to the support cup adjustment clip 70. Strap 80R/80L may be generally inelastic, or-alternatively, to lessen the amount of movement imparted to the top -of the elastic breast cup, the strap 80R/80L may itself be elastic and may thus serve to absorb some of the movement resulting from adjustments to the shoulder strap. By not drawing the top of the breast cup upward in proportion to the adjustments made, a greater amount of the woman's breast may thus be exposed as part of the enhancement.

This "reconfiguring" of the inner support cup can take one or more of several different forms. In one form, the stitching, 21R/22R and 21L/22L, marked by the "X," to secure the inner support cup to the respective breast cup may be stitched using inelastic thread that is repeatedly stitched to rigidly connect, the inner support cup at the those locations to the respective breast cups, to essentially form a pivot point.

Figure 5:
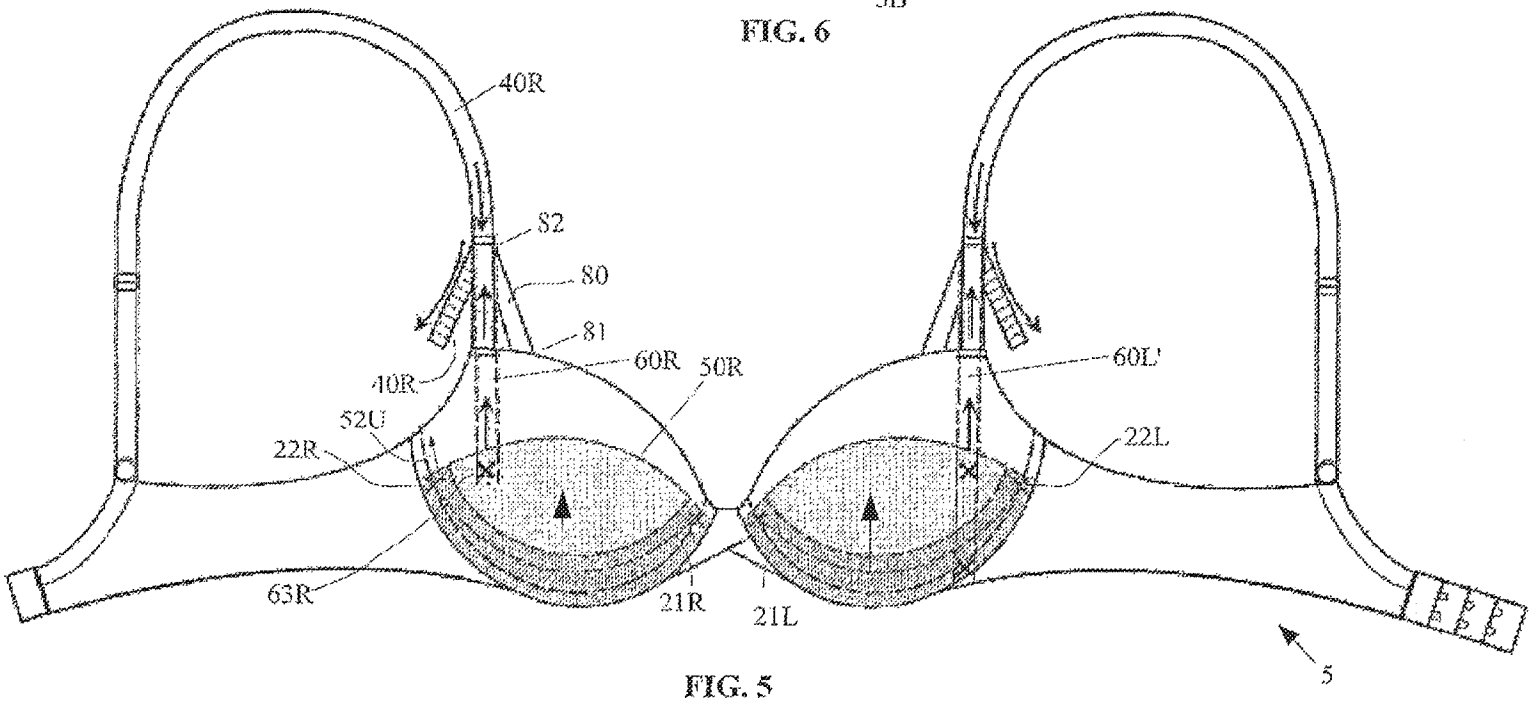
FIG. 5 is the front view of the vertically adjustable support bra of FIG. 2A, with the inner cup occupying one of several possible vertically-adjusted positions.

When the vertical force resulting from shortening of the shoulder strap is reacted by the stitched connection 63R with the inner support cup 50R, the curvature of the flexible stiffening member 54 of the inner support cup may no longer correspond to the curvature of the underwire, and may be elevated vertically. The vertical elevation may vary from being a zero amount of elevation at the stitched connection 63R, to being at a maximum amount of elevation at a lower central point of the inner support cup. The flexible stiffening member 54 may be a rubberized member that may independently accommodate such deformation to result in the reconfiguring of the inner support cup, as seen in FIG. 5, without affecting the shape and positioning of the breast cup underwire and periphery. Where a flexible stiffening member 54 may be made of a stiffer plastic material, its reaction to the loading from the support strap may not necessarily accommodate such deformation independently to reconfigure the inner support cup, and it may affect the shape of the breast cup underwire and periphery by, for example, causing a slight increase to breast cup underwire's radius of curvature.

Alternatively, where a flexible stiffening member 54 may be made of the stiffer plastic material, its reaction to the loading from the support strap may nonetheless accommodate such deformation Independently to reconfigure the inner support cup, through the use of elastic threading being used at the stitching locations, 21R/22R and 21L/22L. Such elastic threading may provide a soft attachment point that may permit some upward movement to the ends of the flexible stiffening member 54, as illustrated by the arrow 52U in FIG. 5, in addition to some pivotal movement.

Each of these deformation types for the inner support cup may result in substantially vertical elevation to the wearer's breast, rather than causing the inward displacement of the breast typical of prior art breast positioning brassieres, which is generally not healthy for a woman's breast tissue, when the points 21R and 22R are positioned generally very close to same height above the lowest point of the cup. Subsequent adjustments may be made to the shoulder strap herein to cause additional elevation of the woman's breast to further accentuate the curviness of her figure, and similarly, the adjustments may be undone to restore the inner support cup to its normal position, with the curved bottom surface 53 again nesting close to the bottom portion of the breast cup underwire. Restoration may occur by releasing of the shoulder strap to increase its effective length. Return of the inner support cup to its normal, nested position in the breast cup may be achieved solely through the stiffness of the flexible stiffening member 54 elastically returning to an un-deformed condition after removal of the load from the support strap 60, which may be adequate where the member is made of the stiffer plastic material. It may be understood from viewing FIG. 5, that where the support point locations 21R/22R and 21L/22L are varied, other than substantially vertical lift, may result. For example, where the inner support point 21R may instead be at a position closer to the lowest point on the cup (nearer the cup's center, as for point 21' in FIG. 6), the upward directed force on the inner support cup by the support strap 60 would tend to have both a vertical component of lift, but also an inward component of lift.

Return of the of the inner support cup to its normal, nested position may also be achieved by using a-strap 68L' in which the strap extends downward (FIG. 2A) to have a first end 61' be stitched using stitches 64L to a bottom portion of the breast cup being proximate to the underwire 25/26, while stitches 63L may secure the strap 60L' to the top portion of the inner support cup. In this embodiment, the region, of the strap 60L' from its first end 61' and extending slightly beyond stitching 63L may preferably be a somewhat loose elastic material, to provide a restoring force for when the inner support cup is elevated vertically, while the remainder of the strap 60L' may preferably be generally inelastic, to be better able to transmit the force to cause the vertical elevation of the inner support cup.

To better assist the wearer of the bra in making vertical adjustments to the inner support cup to accentuate her figure, the support cup adjustment clip 70 may comprise a member that may accommodate incremental adjustments, rather than the continuous advancement provided by the strap length adjustment clip 118. This incremental adjustability may also assist the wearer in quickly restoring the bra back to its normal condition. Several alternatives for a support cup adjustment clip 70 permitting such incremental adjustment may comprise incorporating therein a "prong" that may be received in one or more openings in the shoulder strap 40L/40R. These alternatives are illustrated in FIGS. 3A through 3G.

In FIG. 3A, the "prong" may comprise a portion of the hook, member 210 protruding laterally and then downward to form a hook 211. Hook member 210 resembles a type of clasp that is often used as a center-front bra closure means. The corresponding shoulder strap 40Ri may have two or more loops that may be integral thereto or be stitched onto a portion proximate to its second end, forming a series of loops, 45A, 45B, 45C, 45D, etc. The normal position for the inner support cup 50 of the bra 5 may be with, the hook 211 of hook, member 210 releasably received, through end opening 45Ai of loop 45A and exiting out from end opening 45Aii. Reconfiguring of the inner support cup to a vertically elevated position may occur by releasing/removing the hook 211 from the loop 45A and inserting it into loop 45B. Additional reconfiguring may occur by movement of the hook 211 of hook member 210 from loop 45B to loop 45C, or loop 45D, or other loops where they may be provided.

A sufficient number of loops may be provided according to a predictable amount of total elevation that may be expected to be desired for a certain cup size, along with adequate loop spacing to provide for a desired incremental amount of loop-to-loop adjustment, which may be in the range of approximately $1/8^{th}$ of an inch to approximately ½ of an inch. The second end 62 of support strap 60 may be attached to a circumferential portion of the hook member 210, while the breast cup support strap 80 may similarly be attached, or it may be stitched to the support strap 60, or alternatively, the support strap 60 and breast cup support strap 80 may comprise a single strap which may pass through the circumferential opening in hook member 210.

In FIG. 3C, the "prong" may comprise a pivotal prong 221 of the buckle member 220, being pivotal about a center bar 222 that is supported by frame 223. The second end 62 of support strap 60 may be attached to a portion of the frame 223, while the breast cup support strap 80 may be attached as previously described, or may be attached to the center bar 222 as illustrated. The corresponding shoulder strap 40Rii may have two or more openings that form a series of openings, 46A, 46B, 46C, etc. To be more durable the openings may comprise eyelets, according to U.S. Pat. No. 4,890,362 to Odajima for "Eyelet and Method of Attaching the Same," the disclosures of which are incorporated herein by reference. One of the eyelet openings may be releasably received by the prong to provide the aforementioned normal position or the amount of vertical elevation.

In FIG. 3D, the "prong" may comprise a hook portion 231 of the swan hook member 230 that may be secured relative to a frame 232. The second end 62 of support strap 60 may be attached to a portion of the frame 232, while, the breast cup support strap 80 may be attached as previously described. The corresponding shoulder strap 40Riii may have two or more openings/eyelets, 46A, 46B, 46C, etc., as previously described. One of the eyelet openings of shoulder strap 40Riii may be releasably received by the hook portion of the swan hook. Releasing the hook portion 231 from the frame 232, as seen in FIG. 3E, permits the eyelet opening of the shoulder strap to be removed from the hook portion and allows the shoulder strap to be fed through, the frame (see FIG. 3D), so that another eyelet may be received by the hook to provide the aforementioned vertical elevation.

In FIG. 3F, another embodiment is shown that does not make use of a "prong" per se, and may utilize a traditional rear bra hook member 240 that may be stitched to the second end 62 of support strap 60, while multiple copies of the corresponding catch 241 may be secured to the shoulder strap 40Riv. The breast cup support strap 80 may be attached as previously described. Mating of the hook member 240 and catch 241 is illustrated in FIG. 3G. Releasing the hook member 240 from one of the catches 241 permits another catch on the shoulder strap to be received by the hook member to provide the aforementioned vertical elevation.

In FIG. 3G, another embodiment is shown that also does not use a prong, and instead may utilize hook and loop fabric pieces 250/251, otherwise known as Velcro. One piece, 250, may be sewn or bonded to the second end 62 of support strap 60R, while the other piece, 251, may be secured to the shoulder strap 40Riv. There may instead be a series of smaller pieces (251*a*, 251*b*, 251*c*, . . . ) on the shoulder strap 40Riv. The use of Velcro permits any custom incremental change to the strap, which may be desirable for smaller breast sizes.

To better conceal the support strap 60 and the inner support cups 50L/50R, the breast cups 20L and 20R may also include a thick layer of padding, which may be an elastic or an inelastic material. The separate padding layer may be added between the breast cup inner and outer layers 20Lo/20Ro and 20Li/20Ri.

Figure 2B:
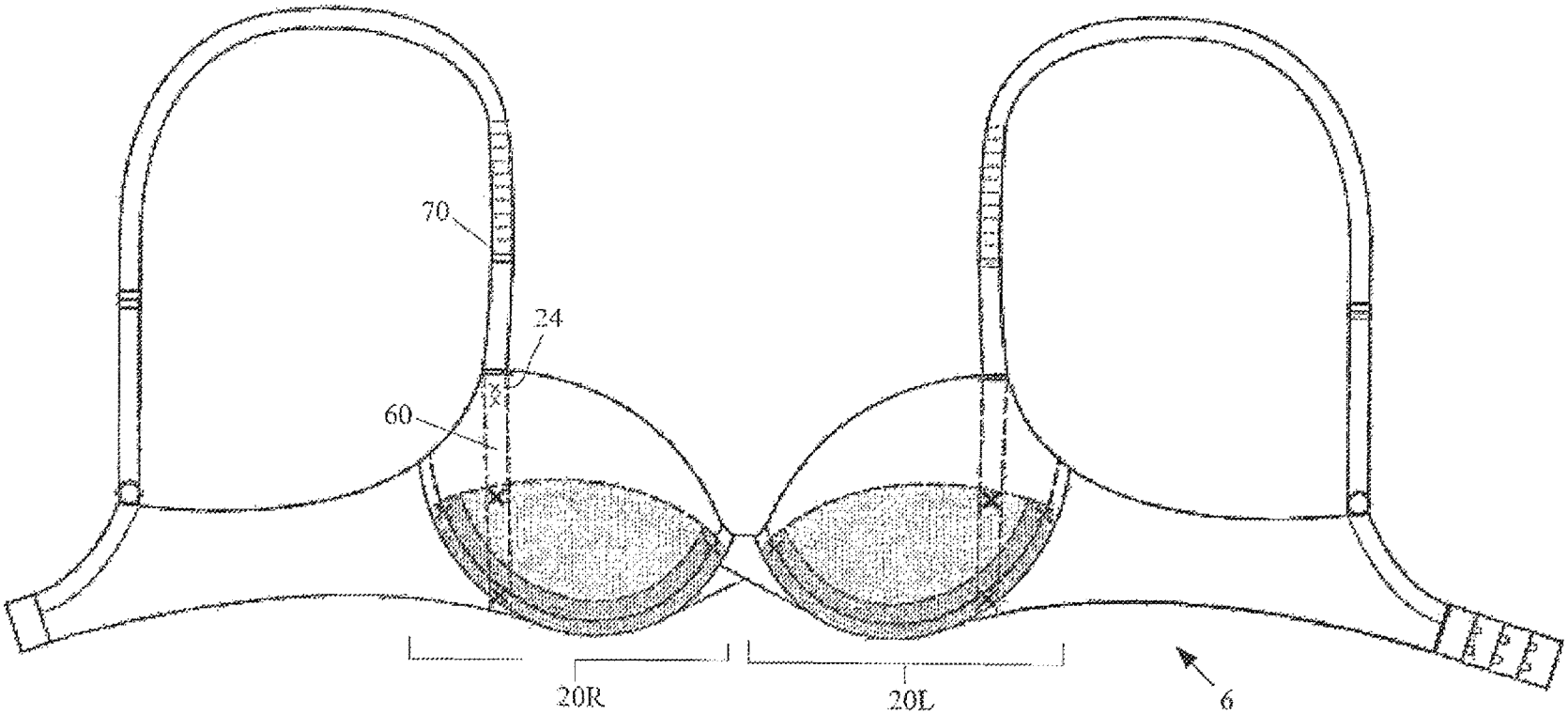
FIG. 2B is the front view illustrating a first alternate embodiment of the vertically adjustable support bra of FIG. 1, showing inner details of the bra's support capability, with the inner cup being in the unadjusted position.

A first alternative embodiment of bra 5 of the present invention is bra 6, which is illustrated in FIG. 2B, which omits the breast cup support strap 80. Support for the upper portion of the breast cups may instead be provided by one or more running stitches 24 that may be loosely applied using elastic threading. So, upward movement of the support strap 60 is generally, though not directly, transmitted to the upper portion of the breast cups 20L/20R.

Figure 7A:
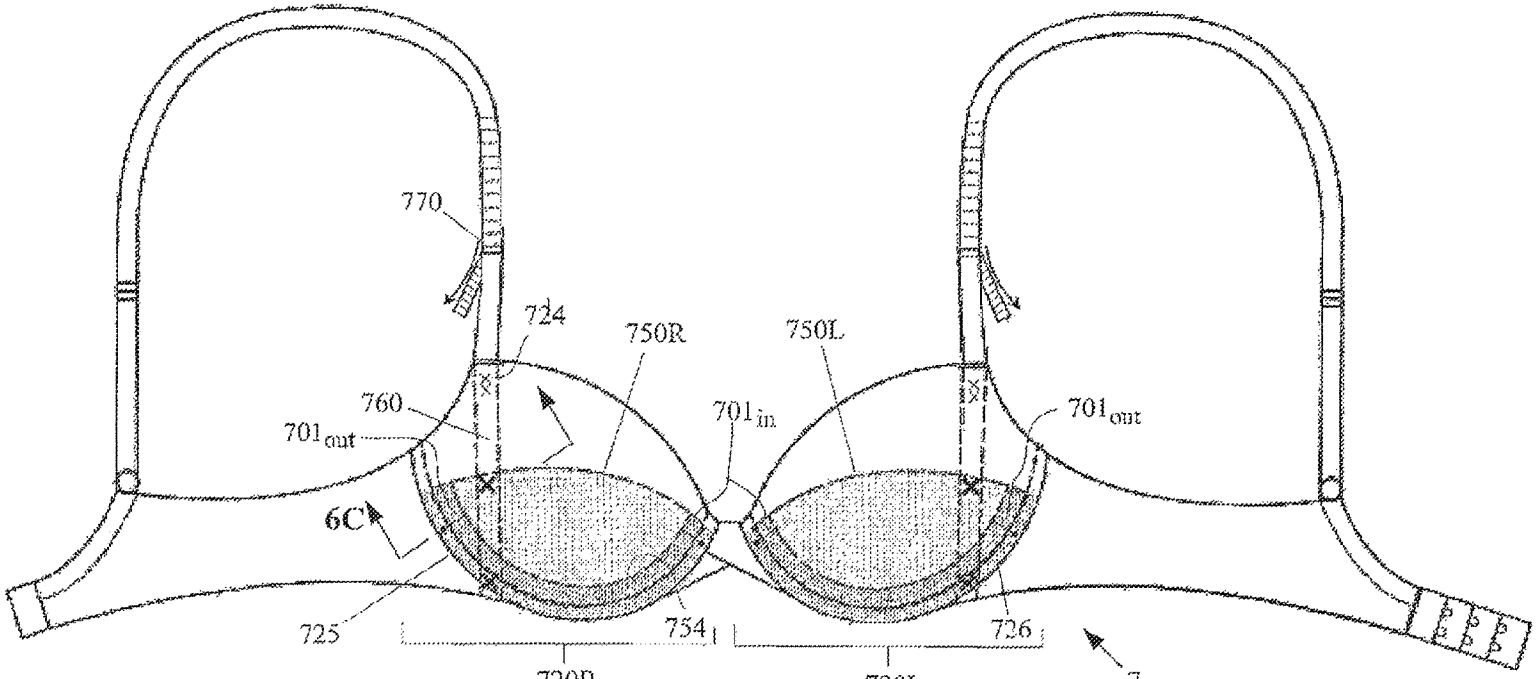
FIG. 7A is a third alternate embodiment of the bra of the current invention, which utilizes an inner support cup adapted for sliding relative to the bra underwire, with the inner support cup being in the unadjusted position.

A second alternative embodiment of the current invention is shown by bra 7, which is illustrated in FIG. 7A. Bra 7 may have left and right breast cups 720L/720R each having a respective inner support cup 750R/750L, which may have one or more particular connections with the bra underwire 725/726 of each cup to permit sliding relative to the underwire. The sliding arrangement may be accommodated by a pin 701 that has a shank portion 702 that may be rigid and may furthermore be secured to the stiffening member 754 of the inner support cup, with a manufactured head portion 703 being cantilevered out from the stiffening -member to be displaced a short distance therefrom. The shank portion may be secured to the stiffening member using an appropriate adhesive, as seen in FIG. 7C, or by deforming (or upsetting) the end-of the pin opposite the head in a fashion similar to a rivet with have a bucked head 702H bearing against the upper side of the stiffening member (FIG. 7D).

Figure 7E:
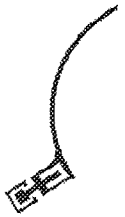
FIG. 7E is the cross-sectional view of FIG. 7C, but where the pin has a manufactured head that comprises a block shape instead of a spherical shape.
Figure 7D:
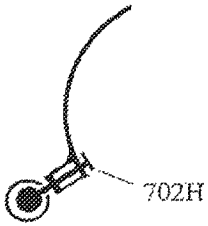
FIG. 7D is the cross-sectional view of FIG. 7C, but with the pin also having a bucked head for securing the pin to the curved stiffening member of the inner support cup.
Figure 7C:
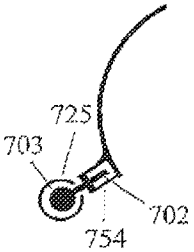
FIG. 7C is an enlarged cross-sectional view through the pin and underwire of the bra of FIG. 7A.
Figure 7B:
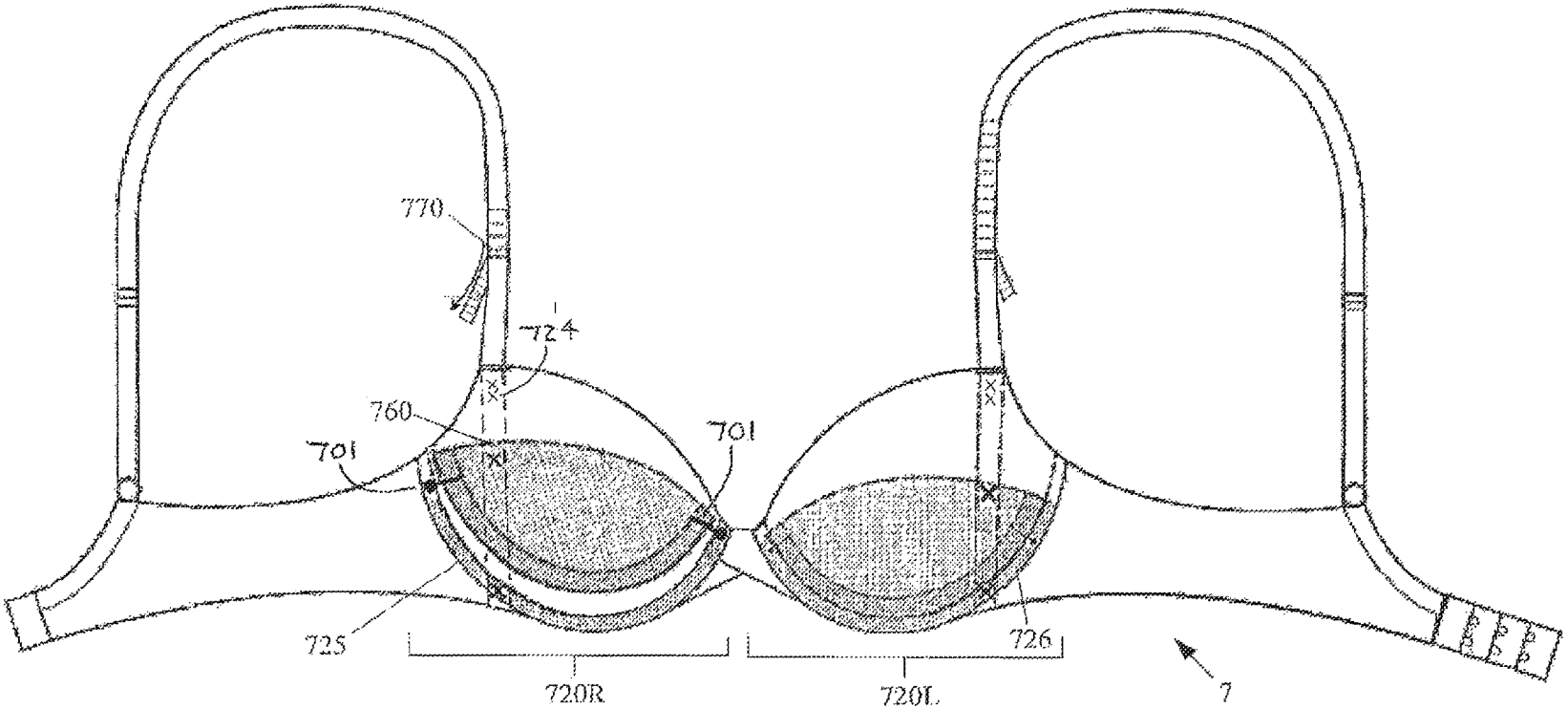
FIG. 7B is the alternate embodiment of FIG. 7A, shown with the inner cup occupying one of several possible vertically-adjusted positions.

This arrangement is shown enlarged in FIGS. 7C and 7D, with the head portion being spherical, and in FIG. 7E with the head portion comprising a rectangular block with rounded edges and comers. The spherical head portion 703 may be slidably received within a hollow portion of the bra underwire, which may, but need not, extend for the entire length of the underwire 725/726. As seen in FIG. 7A, each inner support cup 750R/750L may have the shank of two pins 701 secured to its stiffening member, with the shank of the pins being respectively secured proximate to, or generally near to, each end of the cup. When the support strap 760 is adjusted upwardly using one of the previously described support cup adjustment clips 770, the inner support cup may elevate as seen for the right-side cup 720R in FIG. 7B, by having the head portion 703 (spherical or block) of each of the pins 701 track (slide) within the hollow portion of the underwire 725. Due to the corresponding curvature of both the underwire 725/726 and the stiffening member 754 of the inner support cups, elevating the inner support cups to be displaced from the underwire as shown, may require some deformation of the underwire and/or some deformation of the stiffening member, which may be acceptable. Where such deformation is not acceptable, the shank portion 702 of the pin 701, rather than being a single rigid member, may instead be adapted to telescope outward under such loading, or it may alternatively be made of an elastic material that may elongate to accommodate some separation between the stiffening member 754 and the underwire 725/726.

It is important to note that because of the positioning of the pins 701 on the inner support cup 750R, and with the location of the attachment of the support strap 760 to the Inner support cup being closer to the pin at the outside end, there will be a natural tendency toward having more translation achieved by the outer pin $\mathbf{701}_{out}$ for a given support strap adjustment than by the inner pin $\mathbf{701}_{in}$. This may result in not only vertical lift, but some, inwardly directed lift as well. This may be adjusted by moving the outer pin location downward to be more centrally located. It may also be adjusted by utilizing a different coefficient of elasticity for the shank portion of the outer pin than for the shank portion of the inner pin, allowing for differential elongation between the two sides. A stiffer elastic shank portion for one of the outer pins may serve to keep it in closer contact with the underwire causing more friction, which may thereby serve to resist motion by the outer pin, and allow more equal tracking motion by the two pins, resulting in substantially vertical lifting.

It should also be noted that in this embodiment, either the outer pin $\mathbf{701}_{out}$ or the inner pin $\mathbf{701}_{in}$ may also be positioned close to the end of the hollow track in the underwire so that after a short amount of tracking (or even no tracking at all) adjustment of the support strap 760 upwardly may cause pivoting about that end. Depending upon which pin was located close to, or at, the end of the underwire track (the inside pin $\mathbf{701}_{in}$ to or the outside pin $\mathbf{70}_{out}$), pivoting may respectively produce upward and inward lifting or upward, and outward lifting. For example, if the outer pin $\mathbf{701}_{out}$ for the left breast cup 720L in FIG. 7A is initially positioned at the end of the track within underwire 726, it would serve as a pivot point, so that adjustment-of the support strap 760 upwardly would cause pivoting about pin $\mathbf{701}_{out}$ and tracking/elongation tor the pin $\mathbf{701}_{in}$.

Figure 8:
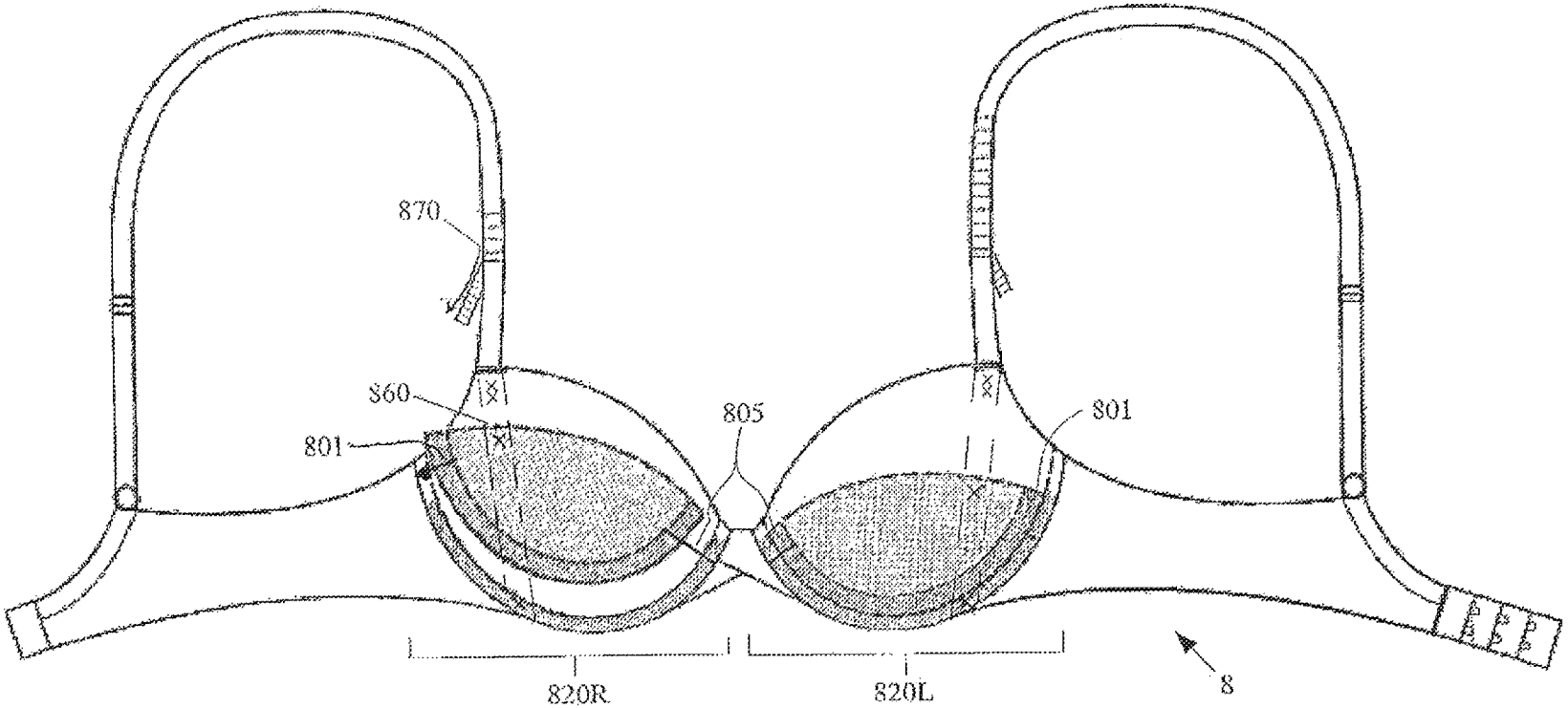
FIG. 8 is a fourth alternate embodiment of the bra of the current invention, which utilizes an inner support cup adapted at a first end for sliding relative to the bra underwire and adapted at a second end for translation that overcomes elastic biasing, with the inner support cup being shown in the unadjusted position for the left-side cup and in the outward/vertical adjusted position for the right-side cup.

A third alternative embodiment of the current, invention is shown by bra 8, which is illustrated in FIG. 8. Bra 8 may also have left and right breast cups 720L/720R with each having a respective inner support cup 750R/750L, which may have specific connections with the bra underwire 725/726 of each cup that permits sliding relative to the underwire for only one side of the inner support cup. This may be accomplished by having a pin 801, as previously described for bra 7 (pin 701), for one end of the inner support cup, and by having only an elastic connection 805 between the inner support cup and the underwire for the other end of the inner support cup. As seen for the right breast cup 820R, adjustment of the support strap 760 upwardly would cause tracking by the pin 801 at the outer end of the inner support cup and translation (elongation of 805) for the inner end pin of the support cup. This arrangement serves to provide more outwardly directed lifting. Also, in this embodiment the support strap 860 may preferably further enable such outward lifting by attaching to the breast cup at the underwire to be at a more central position.

These bra embodiments that provide the above-described customizable lift may be utilized differently from one side to the other (left and right), and may thus be used to correct the differences in size of a woman's beasts. In addition, they may function very well in lifting and redistributing breast tissue independently from side to side to thereby more advantageously serve as a minimizer bra, which may universally tailor the breast tissue distribution differently for each side, instead of requiring a uniquely created bra for each female customer who has her own unique physique.

Figure 9:
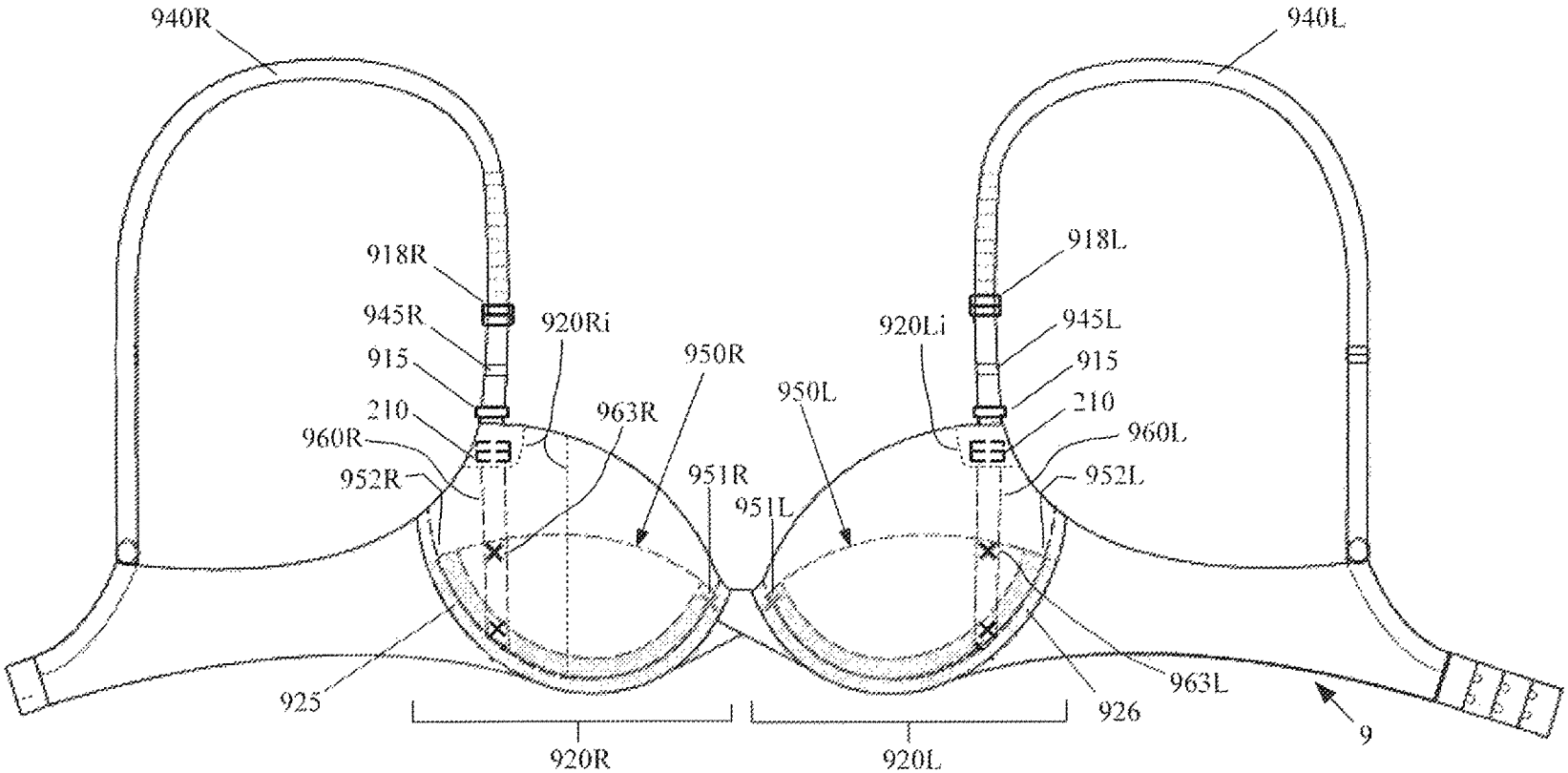
FIG. 9 illustrates another embodiment of an adjustable bra.

Another embodiment is shown by bra 9, which is illustrated in. FIG. 9. Bra 9 may have left, and right breast cups 920L/920R each having a lower portion secured to a bra band, and with an upper portion of each breast cup supported by shoulder straps 940L/940R that may be attached to the respective breast cups using a ring member 915. (Note that although only the right side of the bra may be illustrated and discussed within certain figures and embodiments herein, the left side may be similarly constructed to accommodate the left breast, and its features may be indicated with the same reference numerals but ending with an "L" rather than, an "R").

Each of the breast cups 920L/920R may have a respective inner support cup 950R/950L each of which may have a distal end 952R/952L, and a proximal end 951R/951L (i.e., proximal to the center of the bra), with the proximal ends respectively pivotably secured proximate to the respective underwire 925/926 at positions 951L and 951R, using any of the methods described hereinabove. A support strap 960R/960L, which may be formed of a substantially inelastic material, may have its lower end be fixedly secured to a portion of the respective inner support cup 950R/950L (e.g., at 963R/963L). The upper end of each support strap 960R/960L may be fixedly secured to a respective hook member 210. An inner liner 920Li/920Ri may be fixedly secured to the interior of the respective breast cups 920L/920R, with the hook member 210 freely protruding out from an upper opening, as seen in FIG. 9. The inner liner 920Li/920Ri may cover the entirety of the interior of the breast cup, or may instead only cover the portion of the cup at which the support strap 960R/960L is located, i.e., the distal-most portion, as seen in FIGS. 9-11.

Figure 14:
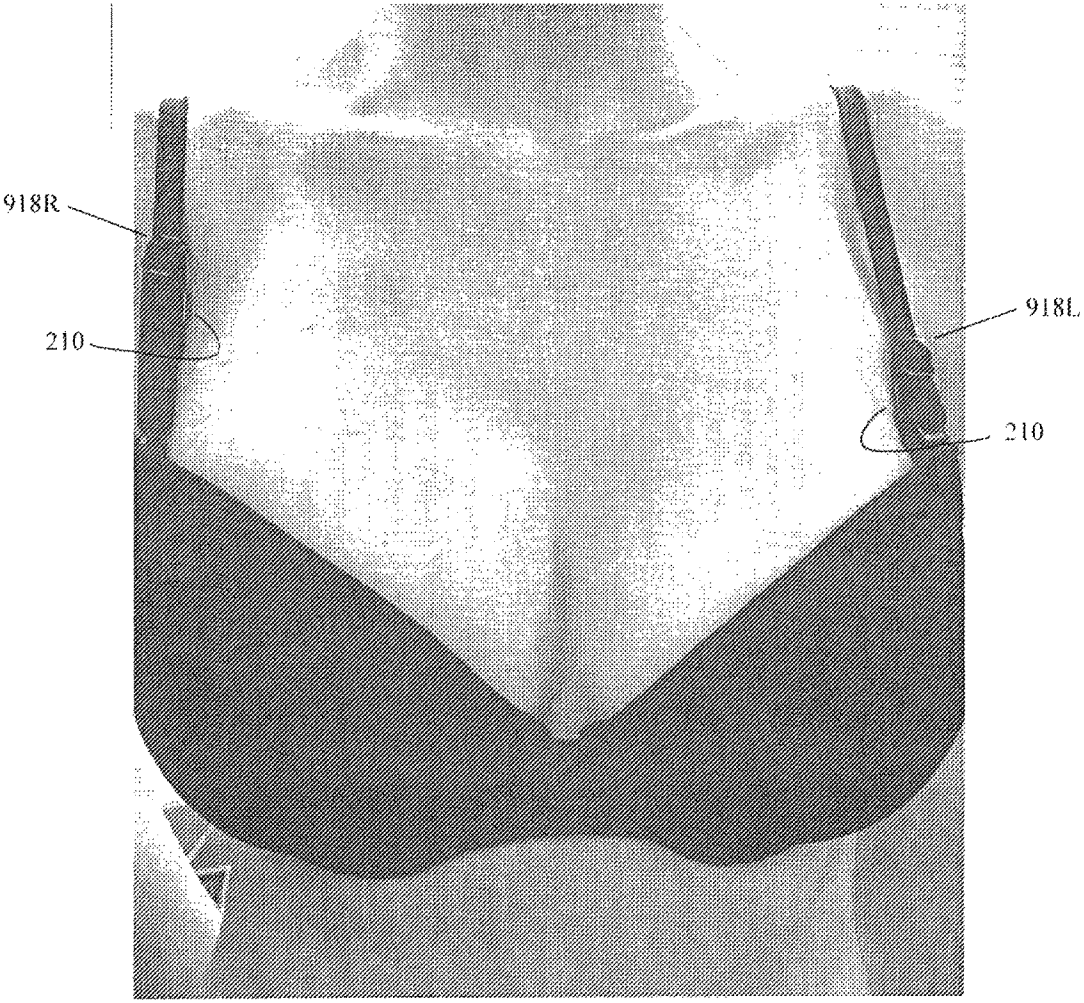
FIG. 14 shows a bra of the present invention, with the right inner support cup and corresponding support strap, and the right shoulder strap all adjusted to provide enhanced lifting of the wearer's right breast, while the wearers left breast is supported normally.

Each of the inner support cups 950R/950L may be individually elevated a desired amount by grasping the corresponding hook member 210 and thereby using the support straps for lifting the cup or the respective cups, and by securing the respective hook members to one of the loops (e.g., loop 945A) that may be positioned on the corresponding shoulder straps 940L/940R. Instead of forming one or more loops in each of the shoulder straps 940L/940R, the hook member 210 may alternatively be secured at the shoulder strap length adjustment clip 918R/918L, either to the clip itself, or to the strap material looped around the clip. The adjustment clip may also be utilized for positioning of the wearer's breasts, as seen in FIG. 14.

Figure 10:
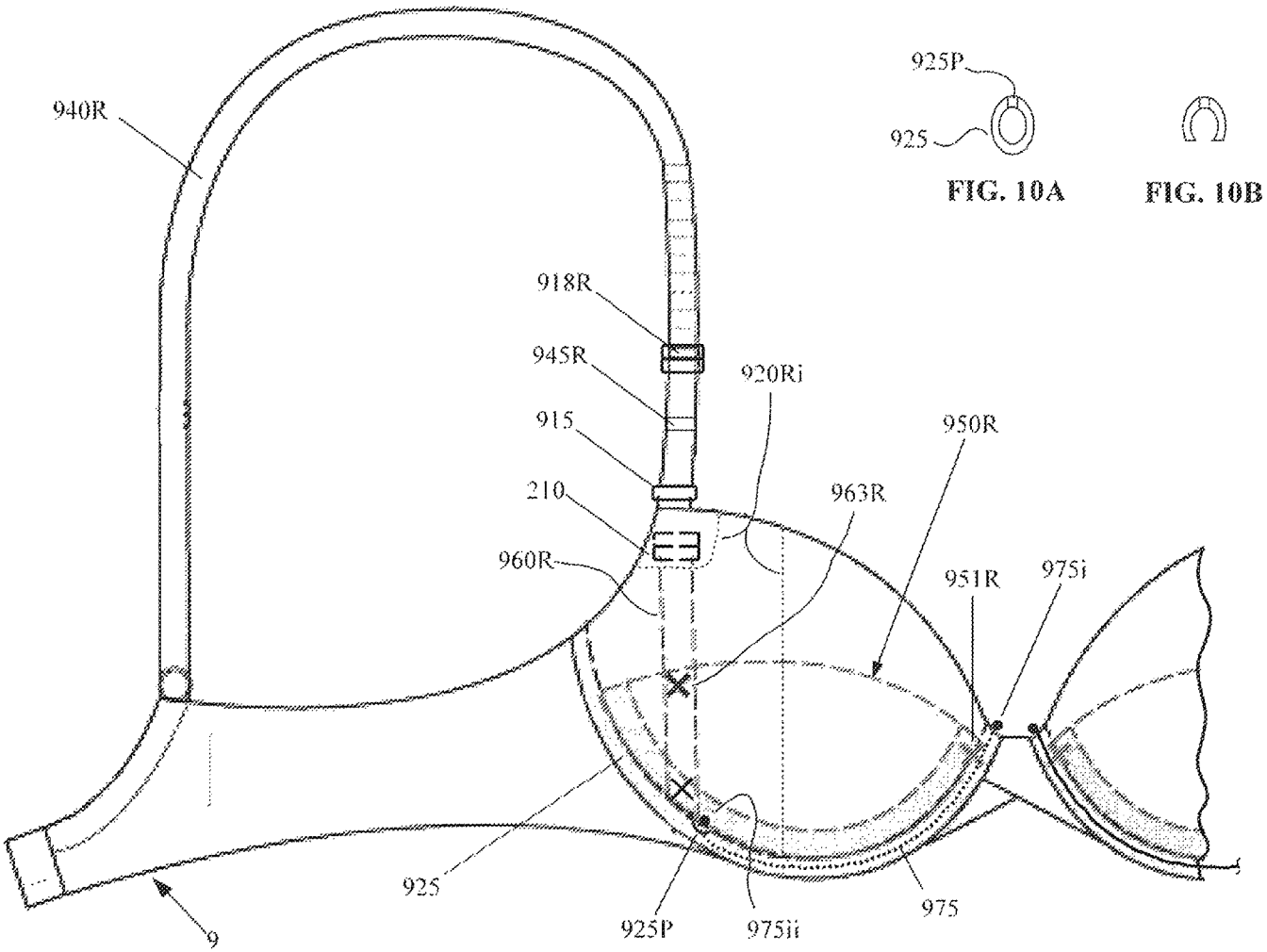
FIG. 10 shows the adjustable bra of FIG. 9, but which also includes an elastic cord disposed within the hollow breast cup underwire that is connected to both the underwire and the inner support cup, being thereby usable to bias the inner support cup into its normal position proximate to the breast cup underwire.

For the inner support cup 950R positioned as shown in FIG. 10 (i.e., normal support, not yet elevated for enhancement), rather than having the hook member 210 merely protruding above the upper opening of the inner liner 920Li/920Ri, where it may freely hang down or may be susceptible to falling behind the tricot liner, the length of the strap 960R may be increased so that hook member 210 may instead be normally hooked upon the ring member 915 in the non-elevated position, or it may be hooked to the portion of the shoulder strap 940R that may be looped around the ring.

Figure 11:
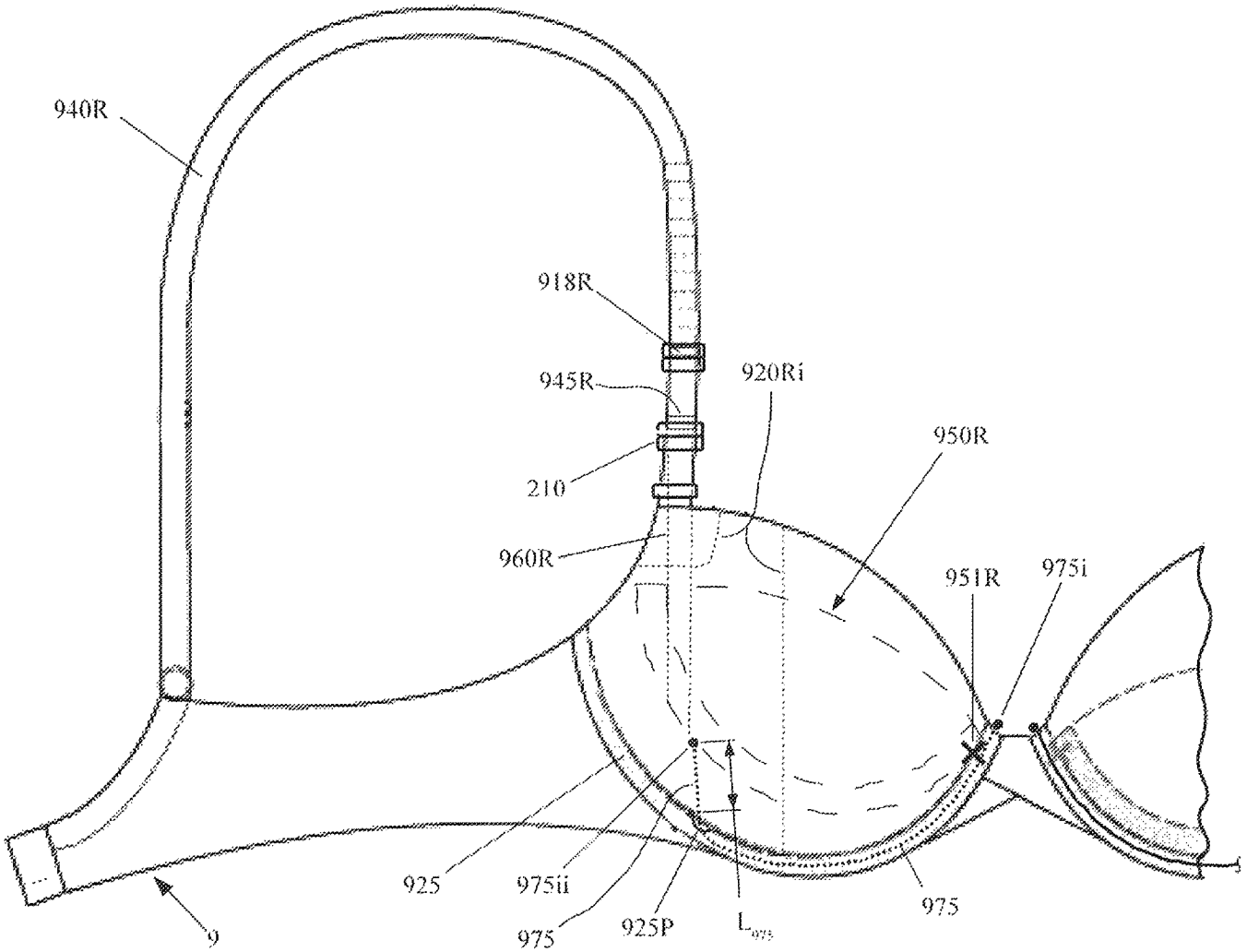
FIG. 11 shows the bra of FIG. 10, but with the inner support cup secured in an elevated position, and the elastic cord elastically deformed/lengthened.

Return of each inner support cup 950R/950L from its elevated position (i.e., as shown in FIG. 11) to the normal nested position (FIG, 10), being proximate to the underwire 925/926 of the respective breast cups 920L/920R, may be achieved using any of the approaches for biasing described hereinabove. However, the length of the biasing member, which may simply be a short piece of elastic material, may only tend to permit an amount elastic deformation that may be insufficient to accommodate the total pivotal movement of the inner support cups 950R/950L necessary for it to move from the normal position to the desired elevated position.

This may be understood by considering the elastic material in terms of a spring. For a spring. Hooke's Law states that an applied, force (F) will result in an amount of deformation (x) that depends upon the spring's inherent stiffness—the spring constant "K" (i.e., F=~K(x)). But the spring constant (K) depends upon several factors, and among them is the spring's length, as the spring constant varies inversely proportional to the length of the spring. Therefore, the shorter the spring (i.e., the shorter the piece of elastic material used for biasing the inner cup back to the normal position), the greater the amount of force needed to deflect the spring the same distance as would be required for a spring having a longer length. This may necessitate the user of the bra having to apply a fairly large force to the hook member 210, in order to lift the inner cup the desired amount Moreover, the deflection required may exceed the elastic capability of the spring (i.e., the elastic capability of the elastic material), after which it may become permanently deformed.

In that respect, the bra 9 of FIG. 9 may feature an improved arrangement for biasing, which may permit easier lifting of the inner support cups 950R/950L, when the wearer desires to move them into an elevated position, but which nonetheless may apply a suitable biasing force to return each of the inner support cups back to the normal position when so desired.

FIG. 10 shows a first embodiment of a biasing arrangement that may be used for bra 9. In this embodiment, the bra wire 925 may be hollow, as seen in the cross-sectional view of FIG. 10A, or alternatively it may be formed to have an open cross-sectional shape, such as a "C"-shaped cross-section shown in FIG. 10B. An elastic cord 975 may be disposed within the open/hollow shaped bra wire 925, and may have a first end 975*i* be secured to a portion of the bra wire (e.g., the proximal end or the distal outer end of the bra wire). The elastic cord 975 may exit from the hollow of the bra wire 925 through a transverse opening 925P, and the elastic cord may have its second end 975*ii* fixedly secured to a lower portion of the inner support cup 950R.

When the wearer of the bra 9 desires to elevate the inner support cup 950R by moving the clip 210 upwardly, so that it may be secured to, for example, the loop 945A, as seen in FIG. 11, the entire length of the elastic cord 975 elongates to accommodate displacement of its second end 975*ii* as a result of movement of the inner support cup. Therefore, knowing the amount of deformation that will be required of the elastic cord 975 (i.e., the distance the second end 975*ii* may move upwardly—$L_{975}$ in FIG. 11), and estimating the handling force that may be desirably applied by the bra wearer to oppose the biasing to elevate the inner support cup (e.g., roughly a pound or two of force), a suitable modulus of elasticity and a suitable length for the elastic cord 975 may be determined to provide the required characteristics.

Although it may be desirable, from a manufacturing standpoint, to secure the first end 975*i* of the elastic cord 975 to the end of the bra wire 925, as seen in FIG. 11, the optimal length of the elastic cord may instead dictate that attachment of its first end 975*i* be at a position between the opening 925P in the bra wire and the end of the bra wire. This attachment location may be accommodated in a number of ways, such as by passing the cord through another opening in the bra wire and knotting the cord, or by crimping of the bra wire onto the elastic cord, or by using/crimping a separate metallic ring secured thereat to the underwire.

Figure 12:
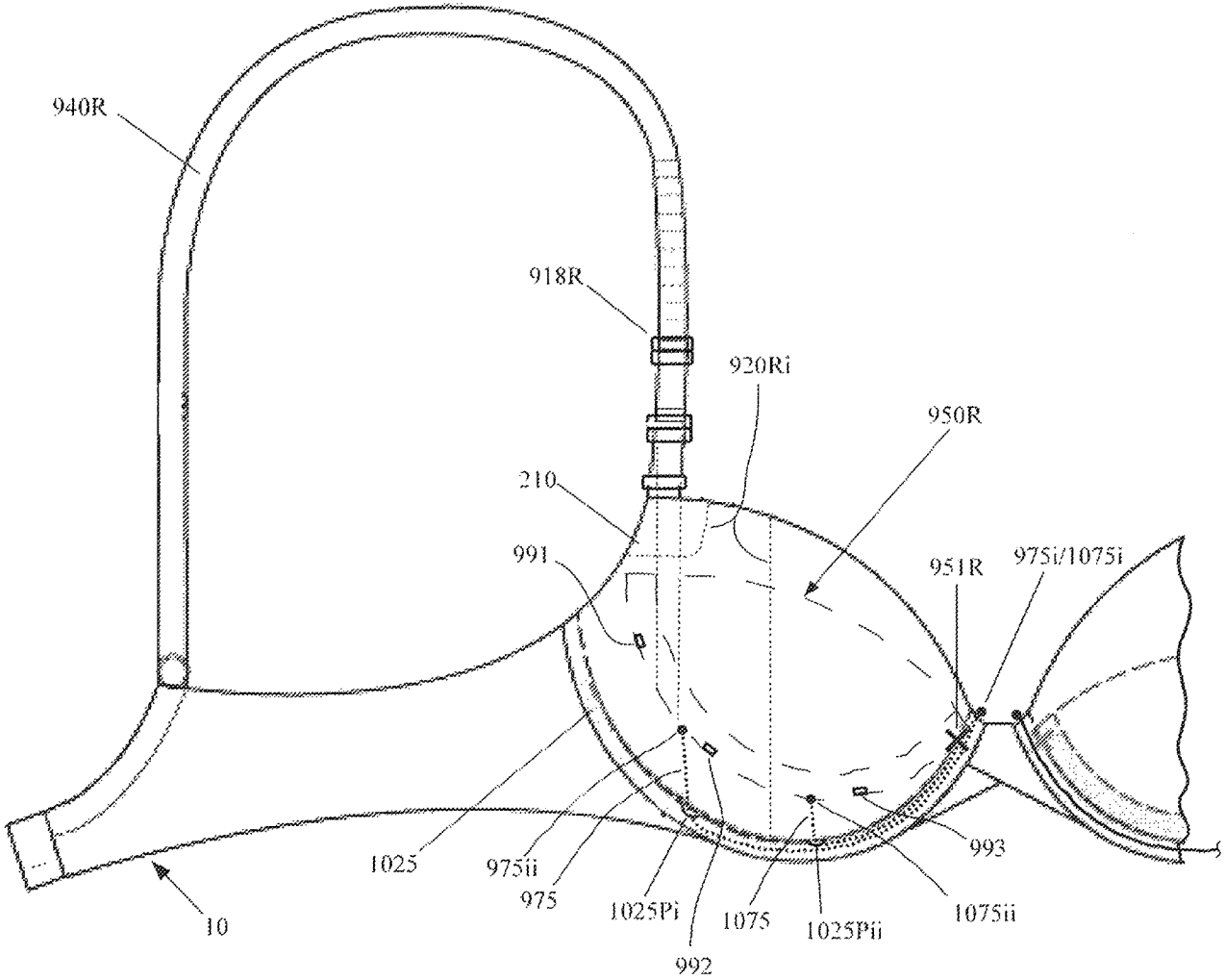
FIG. 12 shows another embodiment of an adjustable bra that is constructed the same as the bra of FIG. 10, except that it includes two elastic cords for biasing of the inner support cup.

In another embodiment shown in FIG. 12, bra 10 may be constructed the same as bra 9, except that the biasing arrangement may include a second elastic cord 1075 that may have a first end 1075*i* that is similarly attached as is end 975*i* for elastic cord 975. However, while the first elastic cord 975 may exit the underwire 1025 through a first opening 1025Pi, the second elastic cord 1075 may exit the underwire 1025 through a second opening 1025Pii that is located closer to the attachment of the inner support cup 950R at 951R. The second end 1075*ii* of the elastic cord 1075 may attach to the inner support cup 950R at a position between the attachment of the second end 975*ii* of cord 975, and the pivot point 951R.

The second elastic cord 1075 may serve to help retain the inner support cup 950R in close proximity to the underwire all along its length, particularly where an underwire is not used for the bottom of the inner support cups 950R/950L. Alternatively, or additionally, magnets (e.g., magnets 991, 992, and 993) may be used in the bottom of the inner support cups 950R/950L, and which may be attracted to a magnet underwire in the breast cups to normally keep the inner support cup in contact therewith, until it is deliberately moved away into an elevated position. Instead of separate magnets, a magnetized underwire may be used in the inner support cups 950R/950 to provide magnetic attraction with a corresponding magnetic underwire in the breast cups.

Figure 13:
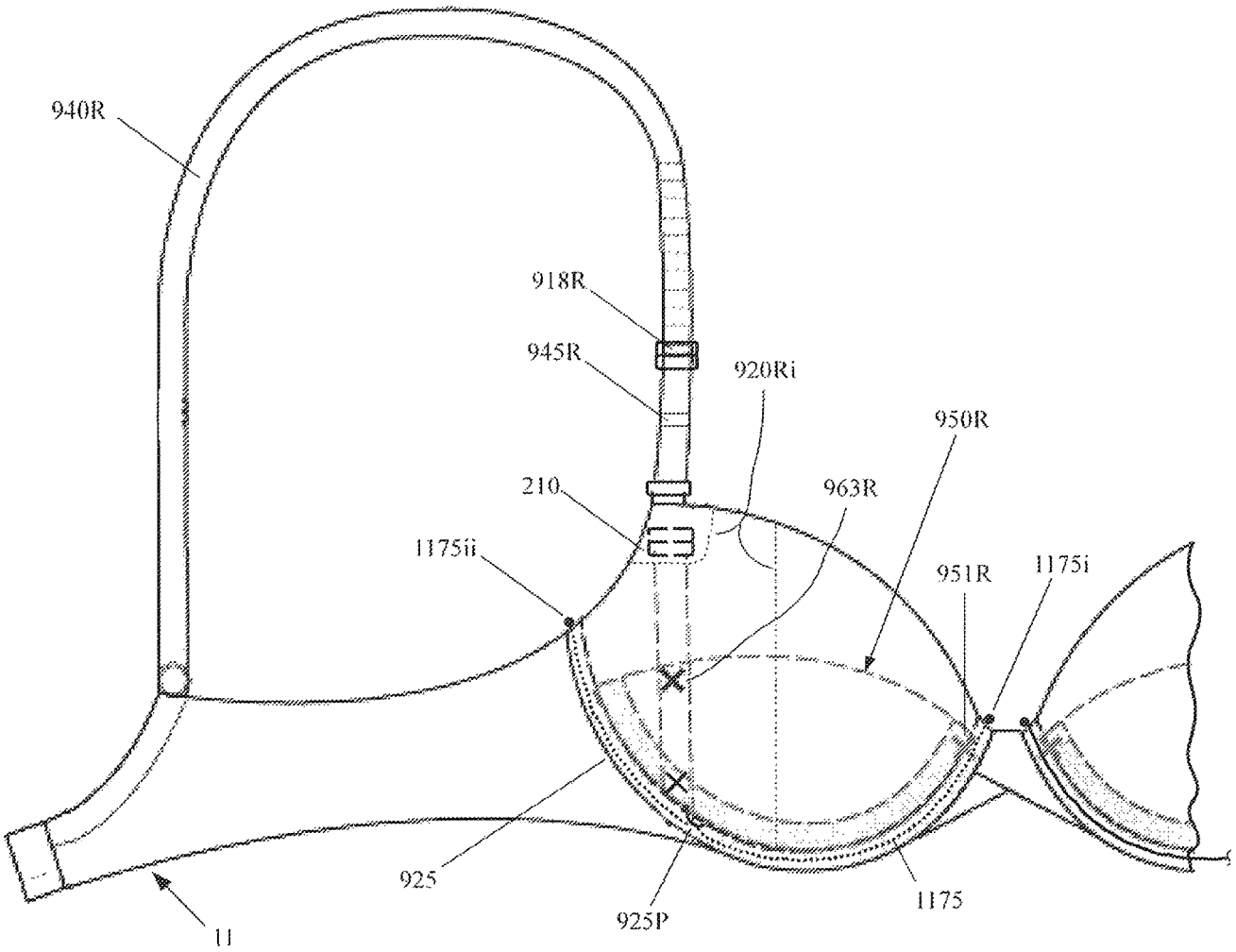
FIG. 13 shows another embodiment of an adjustable bra that is constructed the same as the bra of FIG. 10, except that the elastic cord has a length that is configured to span between both ends of the breast cup underwire, and it has a portion therebetween being connected to the inner support cup to pro vide biasing thereto.

In another embodiment shown in FIG. 13, bra 11 may be constructed the same as bra 9, and its elastic cord 1175 may have a first end 1175*i* that is similarly attached at the proximal end of the breast cup underwire, but the second end 1175*ii* of the elastic cord may instead be attached at the extreme outside (distal) end of the breast cup underwire. A portion of the elastic cord 1175 proximate to the opening 925P in the breast cup underwire 925 may be stitched or otherwise fixedly secured to the inner support cup 950R, to thereby provide return biasing to the elevated support cup.

Figure 15:
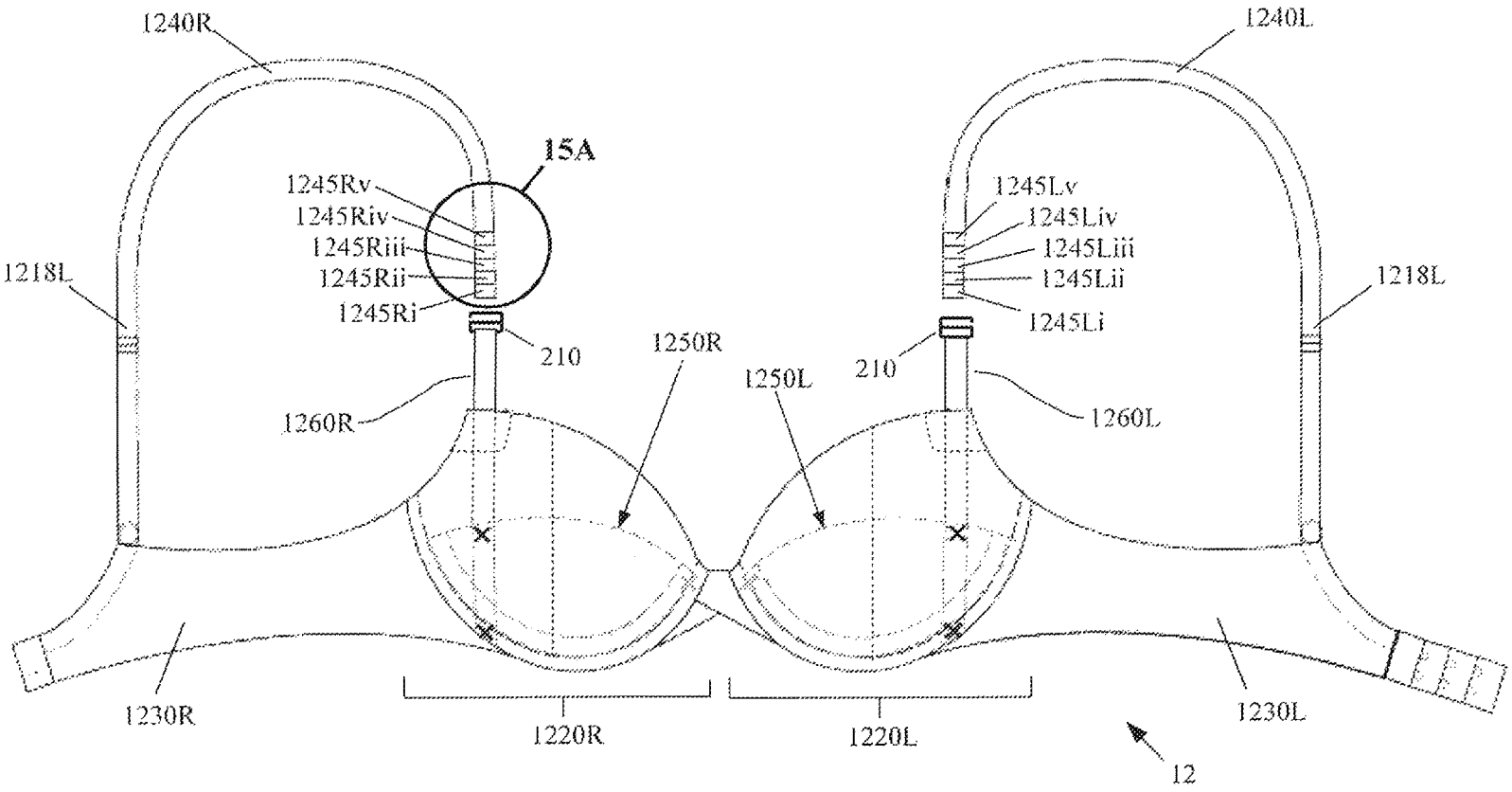
FIG. 15 illustrates an alternate embodiment, of the adjustable bra shown within FIGS. 9.

FIG. 15 illustrates a bra embodiment 12 that may be formed similar to the bra embodiment 9 shown in FIG. 9, except that each of the breast cups 1220R/1220L are not supported by shoulder straps 1240R/1240L, so that the bra bands 1230R and 1230L along with the breast cups 1220R/1220L may by themselves generally emulate a strapless bra (i.e., a bandeau bra), The shoulder straps 1240R/1240L may only have a first end fixedly secured to respective portions of bra bands 1230R and 1230L. The second end of each shoulder strap 1240R/1240L may have a plurality of loops formed thereon or secured thereto (e.g., loops 1245Ri, 1245Rii, 1245Riii, 1245Riv, 1245Rv, and 1245Li, 1245Lii, 1245Liii, 1245Liv, 1245Lv, etc.), and the shoulder strap may not be directly coupled to the outer breast cups 1220R/1220L. However, the hook members 210 at the ends of each of the support straps 1260R/1260L that are coupled to the inner cups 1250R/1250L, may be hooked to one of the plurality of loops of the respective shoulder straps. The length of each of the shoulder straps 1240R/1240L may be adjustable using the shoulder strap length adjustment clip 1218R/1218L. Each of shoulder straps 1240R/1240L may have its length individually adjusted such that when the hook members 210 at the ends of each, of the support straps 1260R/1260L are coupled to the lowest loop on the respective shoulder straps (i.e., 1245Ri/1245Li), it may just be insufficient to effect any lifting of the inner cups 1250R/1250L, and the bra may essentially act similar to a bandeau bra. However, subsequent relocation of the hook members 210 to any of the other higher positioned loops (i.e., 1245Rii, 1245Riii, 1245Riv, or 1245Rv, and 1245Lii, 1245Liii, 1245Liv, or 1245Lv) may apply a respective load to the inner cups 1250R/1250L, and may thus cause lifting of the wearers breasts that are supported, therein.

Figure 15A:
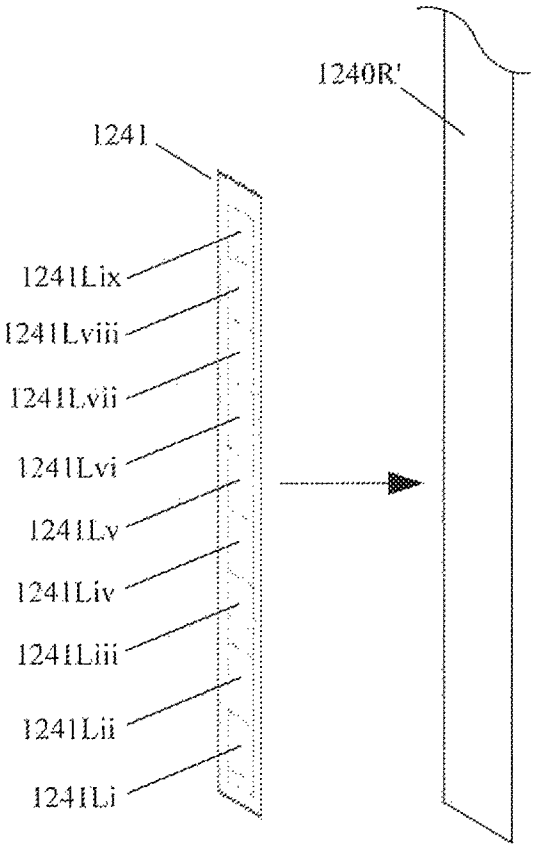
FIG. 15A illustrates a pre-formed plurality of loops on a piece of fabric, prior to being sewn to a bra shoulder strap.
Figure 15B:
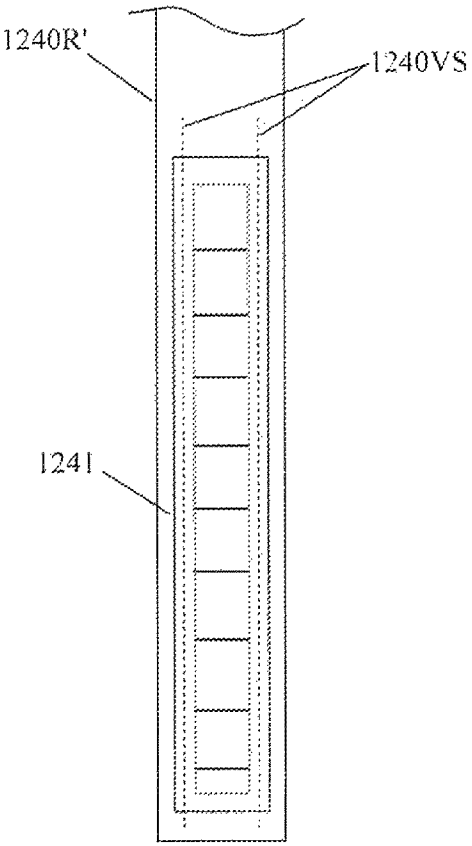
FIG. 15B illustrates the piece of fabric with the pre-formed plurality of loops, as shown in FIG. 15A, but after being secured to the bra shoulder strap.

Rather than forming a plurality of loops on each of the respective shoulder straps 1240R/1240L, a separate fabric part may be sewn to the straps. As shown in FIGS. 15A, the fabric part 1241 may have a desired plurality of loops pre-formed thereon (e.g., nine loops—1241Li, 1241Lii, 1241Liii, 1241Liv, 1241Lv, 1241Lvi, 1241Lvii, 1241Lviii, 1241Lix, for nine height adjustment levels, or 10 loops for ten-adjustment levels). The loops may bulge outwardly, or may be ironed to generally lay flat. The-fabric part 1241 may then be sewn onto the shoulder strap (e.g., strap 1240R') using vertical stitching 1240VS shown within FIG. 15B. The fabric part 1241 may also be sewn onto the front side of the shoulder strap, or may instead be sewn onto its back side so that it wilt not be visible while the bra is worn. The width of the fabric part 1241 may be slightly narrower than the width of the shoulder strap, and may be formed using a 1 mm thick fabric. The fabric part 1241 may be formed of any color, but may, in one embodiment, be formed of a hot pink color to be more visible to the woman when turning the shoulder strap sideways for adjustment of the hook, into one of the loops therein.

Figure 15C:
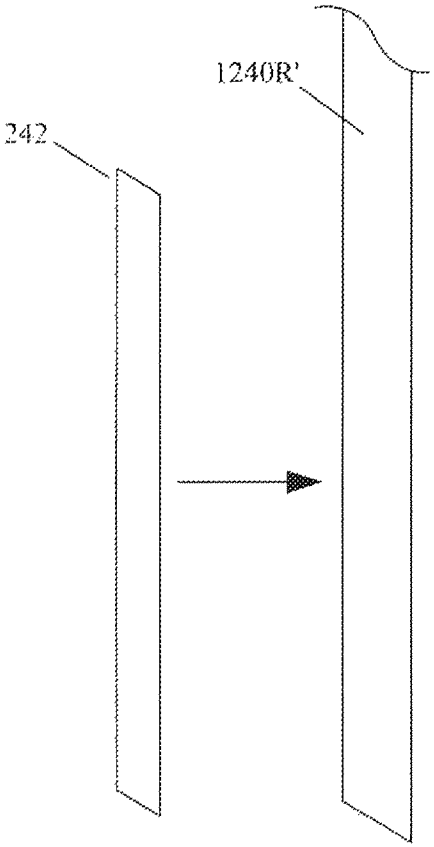
FIG. 15C illustrates a piece of fabric, prior to being sewn to a bra shoulder strap.
Figure 15D:
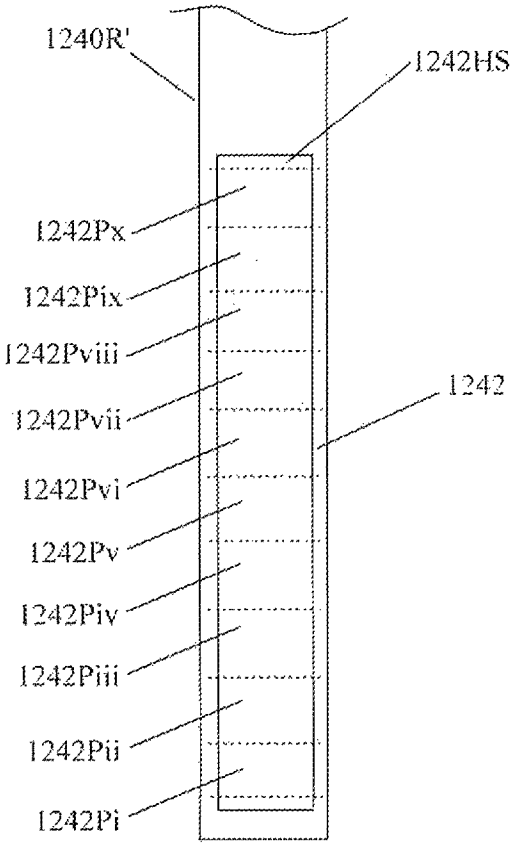
FIG. 15D illustrates the piece of fabric shown in FIG. 15C, but after being secured to the bra shoulder strap at multiple locations.

Alternatively, a fabric piece 1242, as shown in FIG. 15C, without having any loops formed thereon, may be secured to the shoulder strap (e.g., strap 1240R') using stitching, which may be the linear horizontal/lateral stitching 1240HS shown within FIG. 15D. A plurality of the horizontal stitches 1240HS being stitched at different positions on the fabric piece 1242 may produce a plurality of successively elevated regions at which the fabric piece 1242 may be separated, from the strap 1240R' to form openings therebetween (e.g., ten openings positioned at 1242Pi, 1242Pii, 1241Piii, 1241Piv, 1241Pv, 1241Pvi, 1241Pvii, 1241Pviii, 1241Pix). Each, of the hook members 210 may be respectively received in any of the ten openings and be supported by the stitching to provide for ten height adjustment levels.

Figure 16A:
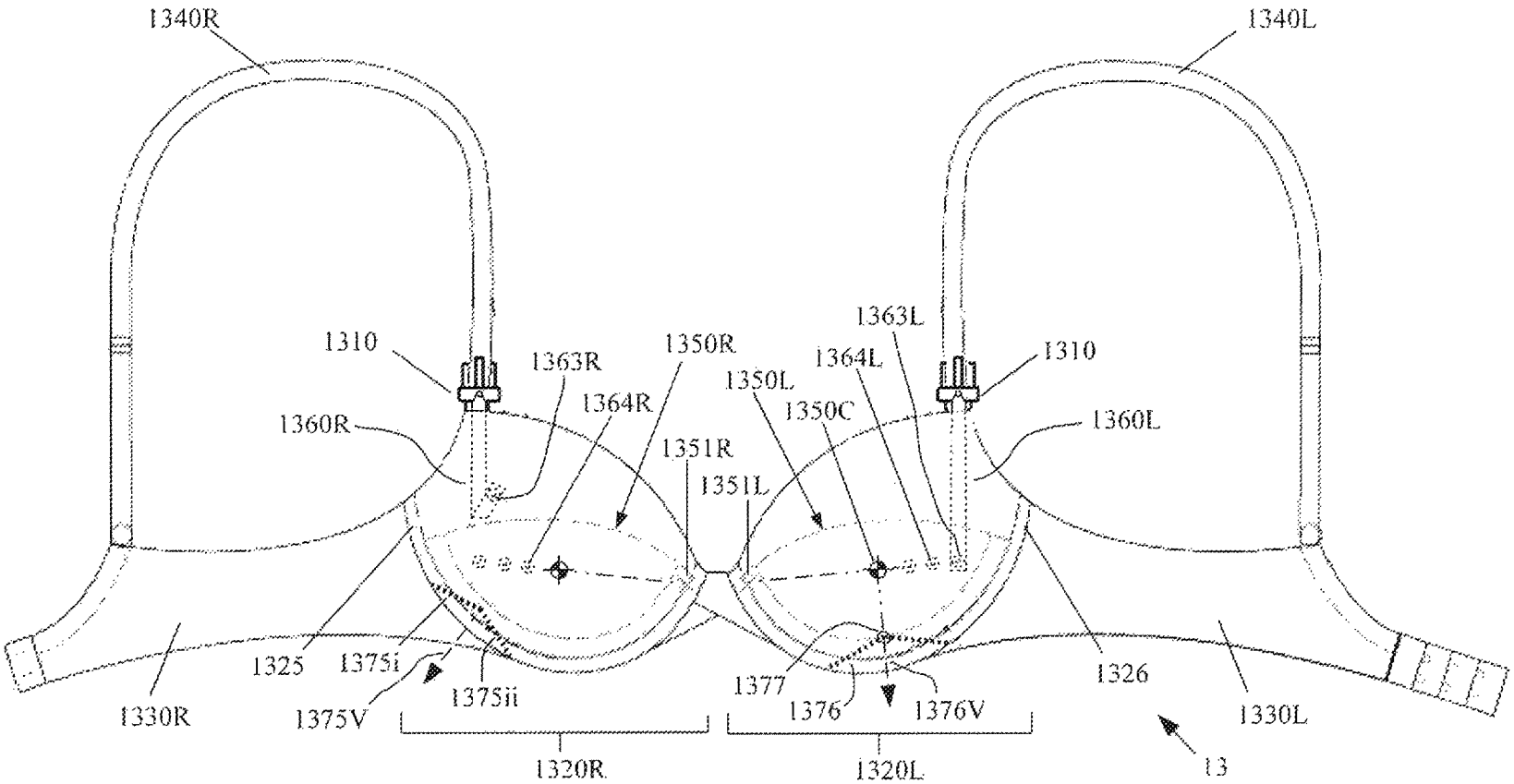
FIG. 16A illustrates yet a different embodiment of an adjustable bra in accordance with the present invention, shown with one releasably attachable adjustment strap detached from the right inner cup, and the other strap attached to the left inner cup.

FIG. 16A illustrates a bra embodiment 13 that may be formed with certain features that may be similar to those found in other bra embodiments disclosed herein, and may also be formed with certain other features that may be constructed differently. Bra 13 may have breast cups 1320R and 1320L that may be secured to the bra band or bands (e.g., bra bands 1330R/1330L). Inner support cups 1350R and 1350L may be pivotally coupled, using any of the methods previously described, at points 1351R and 1351L.

Biasing of each of inner support cups 1350R/1350L into the fully nested position (i.e., as shown in FIG. 16A), being proximate to the underwire 1325/1326 of the respective breast cups 1320L/1320R, without any additional lift being provided for enhancement, may be achieved using any of the approaches for biasing described hereinabove. Alternatively, as shown therein for the right breast cup 1320R, a piece of elastic (e.g., an elastic cord) 1375*i* may have a first end fixedly secured at a selective position proximate to the underwire 1325, and a second end fixedly secured to a selective position on the inner support cup 1350R. The selective positions for the ends of the elastic member 1375*i* may be selected for the member to be angled so that it may have an increased length to provide a suitable spring constant to permit sufficient elongation and pivoting of the inner support cup. A second elastic member 1375*ii* may also be utilized, and may be fixedly secured as shown in FIG. 16A to provide biasing in a second selective direction, and may be such that the sum of the individual biasing forces provided by the two elastic members (1375*i* and 1375*ii*) may provide a total biasing force with a vector direction 1375V that may be normal to the underwire at the point where the elastic members are attached to the inner support cup.

Other positioning for the elastic members may be utilized to provide different vector directions for the biasing. As seen for the for the left breast cup 1320L in FIG. 16A, a single elastic cord 1376 may alternatively be utilized, and may have a first end fixedly secured at a selective position proximate to the underwire 1326. The elastic cord 1376 may pass through a ring 1377 that may be secured to inner support cup 1350L (or which may be an integral ring that may be formed therein), and may have a second end fixedly secured to another selective position proximate to the underwire 1326. The positioning and securement of the elastic cord 1376 may provide a biasing force oriented along a vector direction 1376V that may pass through the centroid 1350C of the inner support cup 1350L, and which direction may also be perpendicular to a line passing through the hinge point 1351L and the centroid, thus generally tending to provide a restoring force for small angular pivoting of the inner support cup with minimal loading at the hinge point.

The upper end of support straps 1360R/1360L for the inner support cups 1350R/1350L may each be fixedly secured to a respective clamp member or other type of slide fastener 1310. The respective clamp member/slide fastener 1310 may permit continuous sliding adjustment with respect to the shoulder strap 1340R/1340L, when in an undamped position, and corresponding lifting of the inner cups by the support straps, when moved from a first clamped position to a second clamped position. The clamp members/slide fasteners 1310 may be formed to be similar to, or the same as, the clamp member of U.S. Pat. No. 3,797,046 to Hoch; or the slider buckle of U.S. Pat. No 5,926,927 to Winkler; or the closure of U.S. Pat. No. 3,703,729 to Hinderer; or the fasteners of either U.S. Pat. No. 2.971,236 to Baker or U.S. Pat. No. 764,238 to Hamilton. The clamp members/slide fasteners 1310 may also be formed with a ratchet arrangement, and may be similar to, or the same as, the waist band adjusting element of U.S. Pat. No. 4,578,827 to Appelt; or the fastener of U.S. Pat. No. 4,780,939 to Belter; or the arrangement of U.S. Pat. No. 1,965,315 to Mainzer; or any other suitable clamp/sliding member.

The lower end of the straps 1360R/1360L may be respectively secured to the inner support cups 1350R/1350L, as described hereinabove. Alternatively, as shown in FIG. 16A, the lower end of each of the straps 1360R/1360L may have a respective snap member 1363R/1363L secured thereto, each of which may be releasably coupled to a corresponding snap member 1364R/1364L that may be fixedly secured to the left and right inner support cups 1350R/1350L. The male and female snap members that may be used on the straps 1360R/1360L and on the inner support cups 1350R/1350L may be as disclosed in U.S. Pat. No. 2,042,866 to Simons, or in U.S. Pat. No. 3,975,803 to Kateyama, or in U.S. Pat. No. 5,003,673 to Nysten, or it may be any other suitable snap fastener. The male snap element may be secured to the straps 1360R/1360L, and the corresponding female snap element may be secured to the Inner support cups 1350R/1350L, or vice versa.

Figure 16B:
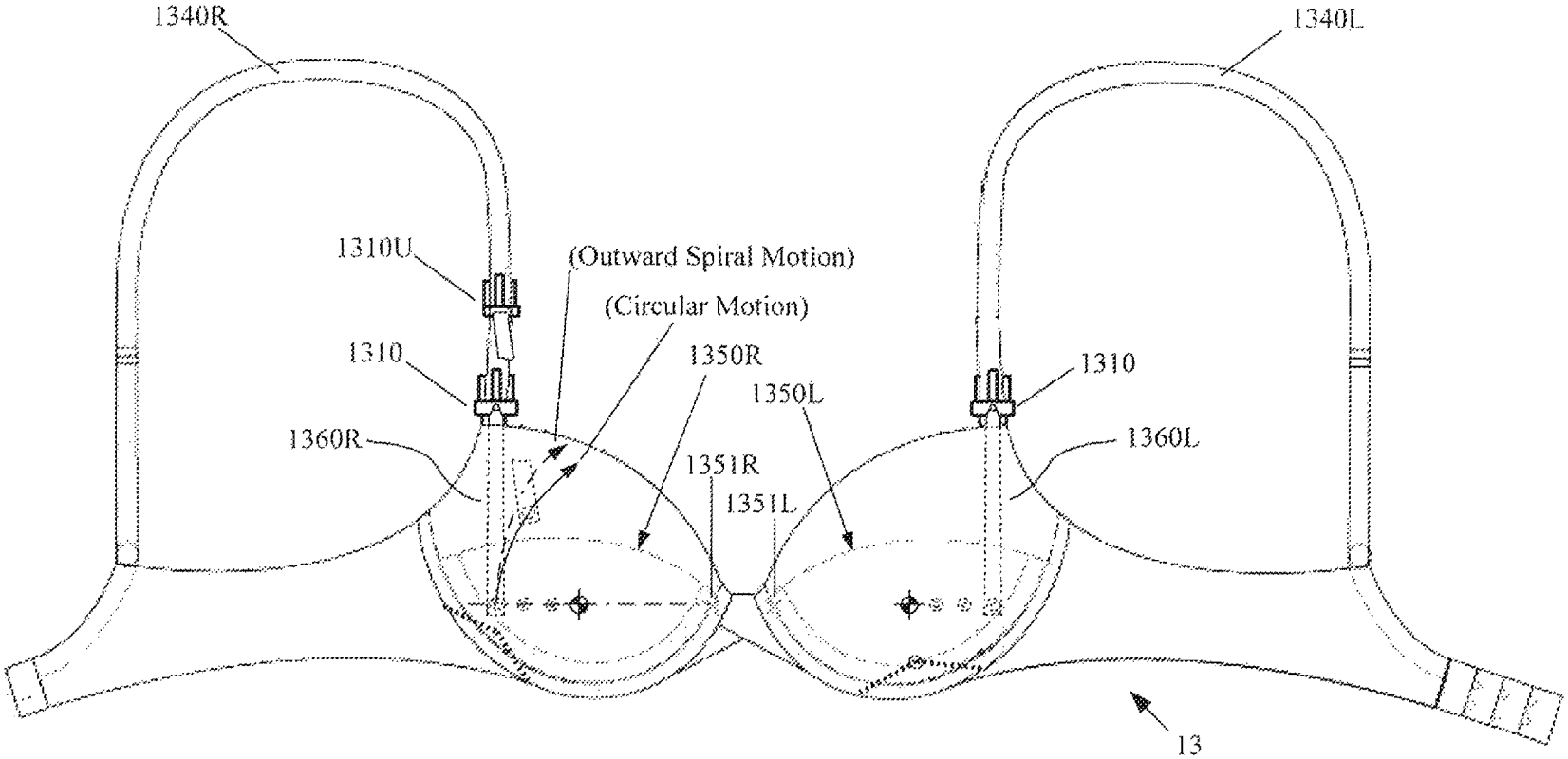
FIG. 16B illustrates the bra embodiment of FIG. 16A, shown with the adjustment strap attached to the right inner cup, and with the clamp member (i.e., the slide fastener) at the upper end of the right, adjustment strap shown at an elevated location on the shoulder strap to reposition the inner cup.

In addition, a plurality of the corresponding snap members may be used on the inner support cups 1350R/1350L to provide for different locations at which the lift may be provided by the straps 1360R/1360L. Thus, as seen in FIG. 16B, where the inner support cups 1350R/1350L may be made of an inelastic material, and they are elevated (e.g., by slide fastener 1310 moving upwardly to a position identified as 1310U, in order for the snap fastener to occupy a second position identified as 1364"), the inner cups may generally pivot with each element thereon moving in a circle segment about the respective pivot points 1351R/1351L. However, where the inner support cups 1350R/1350L may be made of an elastic material, they may generally pivot and may also deform, such that each element thereon may move about the pivot points 1351R/1351L but with an outwardly spiraling motion, as shown therein. Different types of elastic material may be used, with differences in elasticity for each of the two orthogonal directions. For example, the fabric utilized may have a 10% elongation factor, f, or a 20% elongation factor in a first direction, and may be substantially inelastic in the orthogonal direction. Alternatively, the material may have a 20% elongation factor in both directions.

Figure 16C:
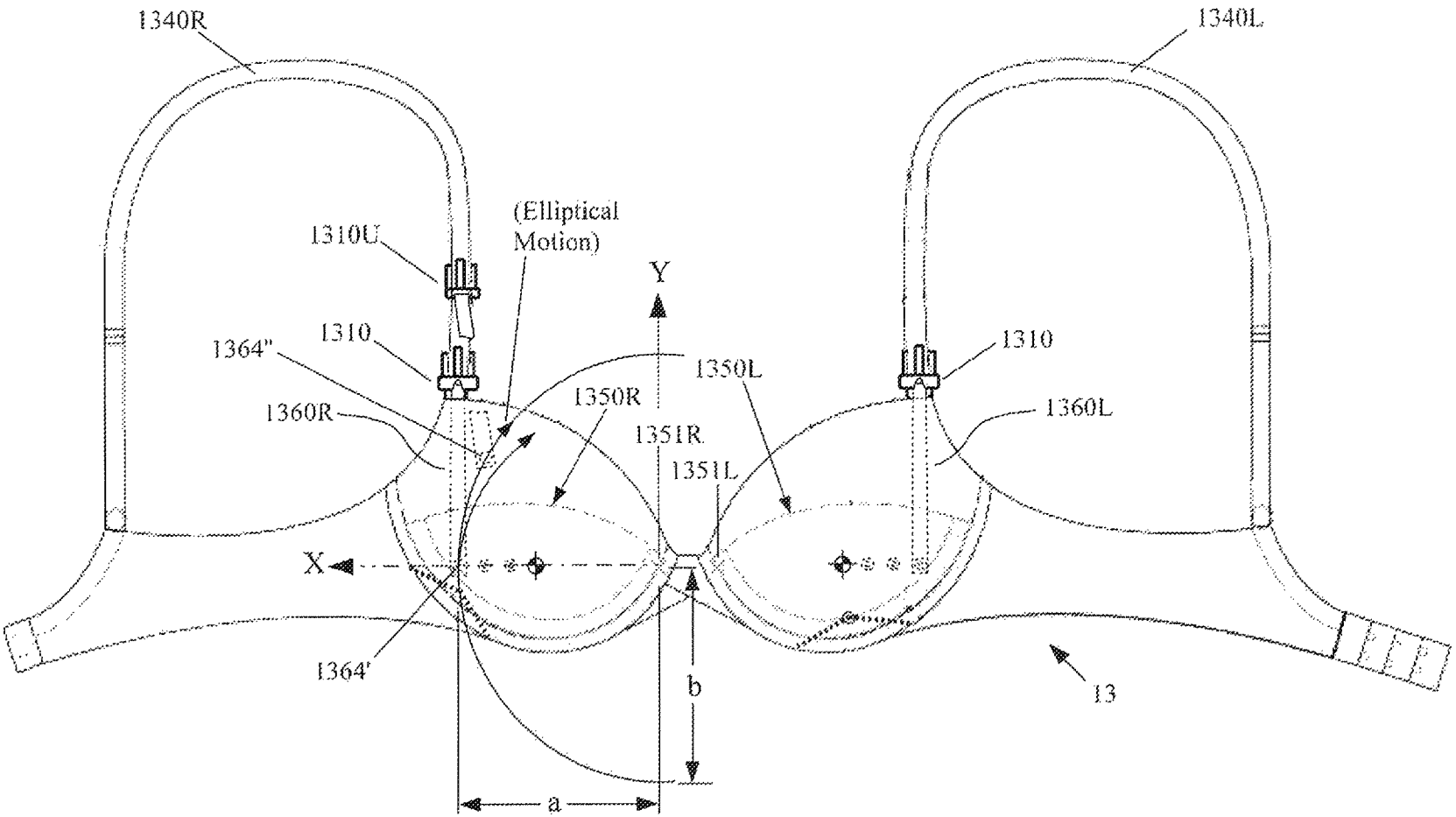
FIG. 16C illustrates the bra embodiment of FIG. 16A, shown with the curved elevational motion of the attachment to the inner cup approximated, as elliptical motion.

For bra 13 shown, in FIG. 16C, the inner support cups 1350R/1350L may for example be made of a fabric with a 20% elongation factor in the lateral (i.e., horizontal), direction with respect to the hinge point 1351R, and may have a zero percent elongation factor in the vertical direction, to be very supportive of the breast retained therein. The motion at the outermost pivot (attachment) point 1364' for the right inner support cup 1350R may therefore be approximated, for small displacement angles, as being elliptical, and its position in the X and Y directions with respect to the pivot point 1351R may be determined mathematically by the following equation:

$$\frac{x^2}{a^2} + \frac{y^2}{b^2} = 1$$

where,

"a"-the height of the ellipse, is the distance between the hinge point 1351R and the attachment point 1364';

"b"-the length of the ellipse, represents the maximum elongation of the inner cup (i.e., b=(f)(a)), if rotated 90 degrees, and for a 20% elongation factor, b=(1.2)(a);

x is a lateral distance between the hinge point 1351R and the attachment point 1364', when the clamp fastener is in the second clamped position; and y is the vertical lift distance for the attachment point 1364', when the clamp fastener is in the second clamped position.

The value may in part be determined by the spacing between the loops, where loops are used to elevate the inner cup, or by the amount of elevation provided by the clamp fastener, where it is instead utilized.

Figure 17:
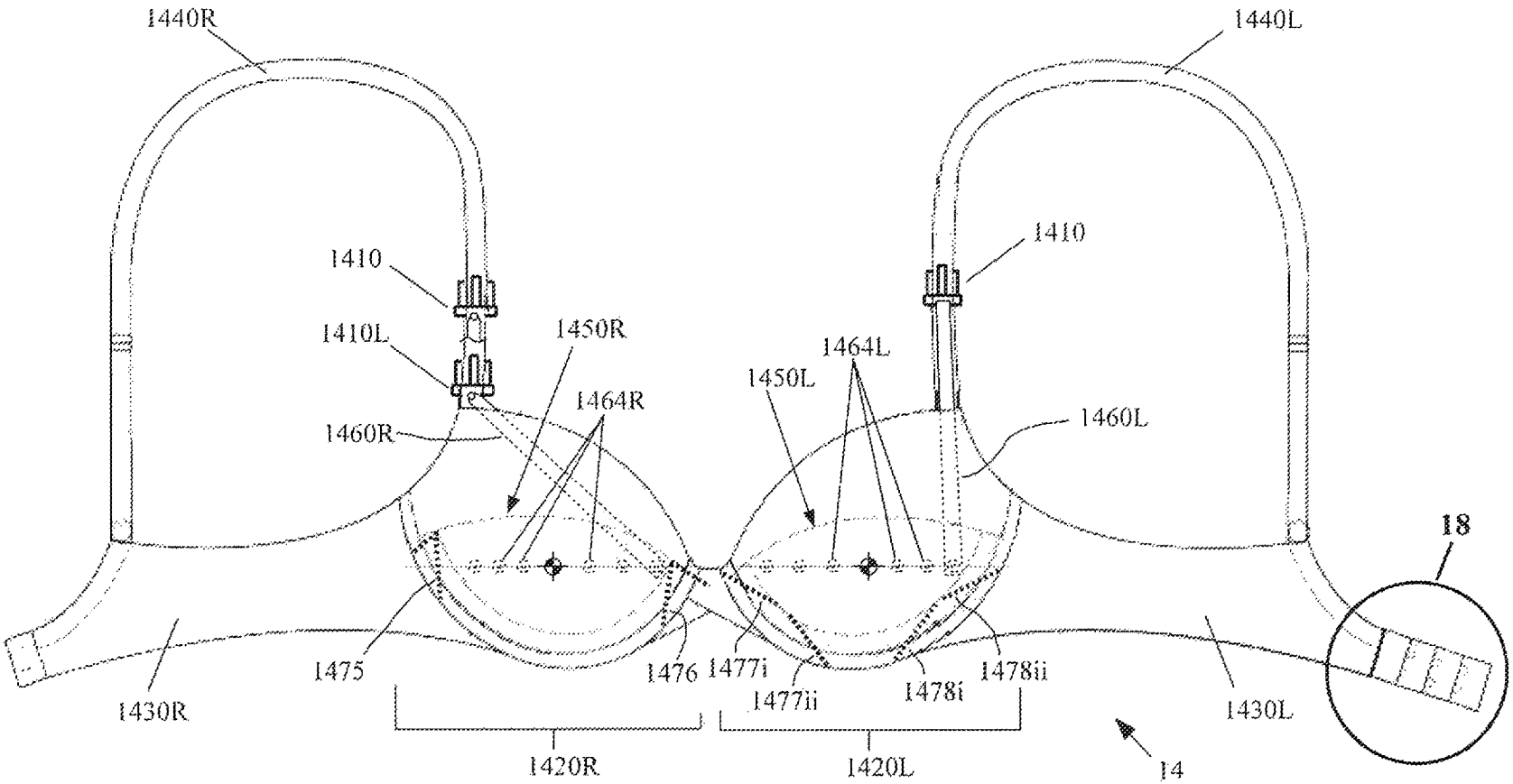

FIG. 17 illustrates a bra embodiment 14 that may be formed with certain features that may be similar to those found in other bra embodiments disclosed herein, and with certain other features that may be constructed differently. Bra 14 may have breast cups 1420R and 1420L that may be secured to the bra band or bands (e.g., bra bands 1430R/1430L). However, inner support cups 1450R and 1450L may have each of its ends be elastically coupled to the breast cups using elastic cords, as discussed above, rather than having one of its ends be pivotally coupled thereto. Different cord arrangements are shown for the left and right breasts (e.g., cords 1475/1476 for the right side, and cords 1477*i*/1477*ii* and 1478*i*/1478*ii* for the left side). Also, the corresponding snap members 1464R/1464L may be utilized and positioned in multiple locations across both sides of the centroid of the inner support cups 1450R/1450L, to permit the support straps 1460R/1460L to be releasably coupled to either side of the centroid. When releasably coupled to the outer sides of the centroid, as shown therein for only the left breast cup, the lifting provided by the support straps 1460R/1460L may not only produce lifting of the wearer's breast, but also pushing of the breasts closer together, for an -enhanced (maximizer) look. Conversely, when the snaps of the straps 1460R/1460L are releasably coupled to the inner sides of the centroid, as shown therein for only the right breast cup, the lifting provided, by the support straps 1460R/1460L may produce lifting of the wearer's breast, and also separation of the breasts, to create a minimized look, wherein the breasts appear to be one or more sizes smaller.

FIG. 18 is an enlarged detail view of one end of the bra strap of the bra shown in FIG. 17, having three pairs of eyelets positioned thereon. FIG. 19A illustrates an alternate embodiment of the end of the bra strap, in accordance with the present invention, having a length adjustment feature. As shown therein, bra band 1430L' may have an connector element 1431 with pairs of eyelets positioned thereon, which may itself be fixedly secured to an elastic member 1432, the distal end of which may be fixedly secured to the bra band. The connector element 1431 may be formed of a substantially inelastic material. The elastic element 1432 may permit automatic length adjustment for the scenario where a woman may be in-between sizes, and it may accommodate an extra inch of adjustment, or an extra two inches of adjustment, or size adjustments depending upon the length of the elastic element 1432 and its elasticity. FIG. 19B illustrates the alternative bra strap end of FIG. 19A, shown in an extended position. The elastic element 1432 may be formed of an elastic material that may have significantly greater elastic stretch properties than the bra band itself, which may tend to be inelastic. As shown in FIG. 19A, a hook or button 1433 may be fixedly secured to the connector element 1431, and may be used to releasably secure the inner end of the inelastic connector element 1431 to the substantially inelastic bra band using button hole 1433BH formed therein. The button being so secured may prevent the extra adjustment possible with use of the elastic member 1432, until it is unbuttoned/unhooked by the wearer, at such time when the elastic adjustment may be deemed necessary.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A brassiere for use in providing a selective amount of vertical lift, said brassiere comprising:

a bra band;

at least one breast cup secured to a portion of said bra band;

a shoulder strap for each said at least one breast cup; each said shoulder strap having a first end secured to said bra band and a second end secured to a respective upper portion of said at least one breast cup;

an inner support cup for each said at least one breast cup, said inner support cup having a first end and a second end;

means of attaching said second end of said inner support cup to a selective location on said at least one breast cup;

means for biasing said first end of said inner support cup into proximity to a bottom portion of said at least one breast cup;

a support strap for said inner support cup of each said at least one breast cup;

means of attaching a portion of said support strap proximate to its first end to a selective location on said inner support cup;

a clamp fastener, a second end of said support strap fixedly secured to said clamp fastener; and wherein each said clamp fastener is configured to be continuously slidable with respect to said respective support strap in an undamped position, to be movable from a first clamped position and to be releasably securable at a second clamped position, to provide a selective amount of vertical lift to said first end of said inner support cup according to a positional change of said first end of said support strap.

2. The brassiere according to claim 1, wherein said positional change of said first end of said support strap follows an elliptical motion given by the equation:

$$\frac{x^2}{a^2} + \frac{y^2}{b^2} = 1$$

where, a is a height of an ellipse formed by said elliptical motion, and is a distance between said selective location on said at least one breast cup, and said selective location on said inner support cup, when said clamp fastener is in said first clamped position;

b is a length of said ellipse formed by said, elliptical motion, and is a maximum elongation distance of said inner cup in accordance with an elongation factor, f, of a material of said inner support cup, where b=(f)(a);

x is a lateral distance between said selective location on said inner support cup and said selective location on said at least one breast cup, when said clamp fastener is in said second clamped position; and y is said selective amount of vertical lift for said first end of said inner support cup.

3. The brassiere according to claim 1, wherein said first clamped position comprises a normal position with zero vertical lift, at which a bottom of said inner support cup is proximate to a bottom portion of said at least one breast cup.

4. The brassiere according to claim 1, further comprising an underwire secured to said bottom portion of each said breast cup.

5. The brassiere according to claim 1, further comprising a tricot liner secured to an inner portion of the breast cups and configured to cover said inner support cup.

6. The brassiere according to claim 1 wherein each said support strap for said inner cup is formed of a substantially inelastic material.

7. The brassiere according to claim 1 wherein each said at least one breast cup is formed of a stretchable material.

8. The brassiere according to claim 1 wherein at least a portion of said inner support cup is formed of a stretchable material.

9. A brassiere for use in providing a selective amount of vertical lift, said brassiere comprising:

a left breast cup and a right breast cup, a portion of each said left and right breast cups respectively secured to a portion of said bra band;

a left shoulder strap and a right shoulder strap, each said left and right shoulder straps having a first end respectively secured to said bra band, and a second end respectively secured to said left and right breast cups;

a left inner support cup and a right inner support cup for said left and right breast cups, respectively; each said inner support cup having a proximal end and a distal end;

means of attaching said distal end of each of said left and right inner support cups, to corresponding selective locations on said left and right breast cups, respectively;

means, of biasing said distal ends for each of said left and right inner support cups, into respective proximity to a corresponding bottom portion of said left and right breast cups;

a left inner cup support strap and a right inner cup support strap for said left and right inner cups, respectively, each having a first end and a second end;

means of attaching said first end for each of said left and right inner cup support straps, to a selective location on said left and right inner support cups, respectively;

clamp means for each said left and right inner cup support straps, a second end of each said inner cup support straps fixedly secured to said respective clamp means; and wherein each of said clamp means are thereby configured to be continuously slidable with respect to said respective inner cup support straps when in an unclamped position, to be independently movable from a respective first clamped position and to be releasably securable at a respective second clamped position, to independently provide a selective amount of vertical lift according to a positional change of each said inner support cup by said respective support straps.

* * * * *